US009908353B2

(12) United States Patent
Nakahara

(10) Patent No.: US 9,908,353 B2
(45) Date of Patent: Mar. 6, 2018

(54) PRINT ASSISTING DEVICE, PRINTING DEVICE, PRINTING SYSTEM, DETERMINING METHOD, AND NON-TRANSITORY COMPUTER READABLE RECORDING MEDIUM

(71) Applicant: CASIO COMPUTER CO., LTD., Tokyo (JP)

(72) Inventor: Shota Nakahara, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/432,319

(22) Filed: Feb. 14, 2017

(65) Prior Publication Data

US 2017/0274691 A1 Sep. 28, 2017

(30) Foreign Application Priority Data

Mar. 24, 2016 (JP) ..... 2016-060926

(51) Int. Cl.
*B41J 29/393* (2006.01)
*B41J 3/36* (2006.01)

(52) U.S. Cl.
CPC ..... *B41J 29/393* (2013.01); *B41J 3/36* (2013.01)

(58) Field of Classification Search
CPC ..... B41J 3/36
USPC ..... 347/109
See application file for complete search history.

(56) References Cited

U.S. PATENT DOCUMENTS

2002/0030830 A1* 3/2002 Day ..... B41J 3/36 358/1.8
2007/0147930 A1* 6/2007 Nishath ..... B41J 3/36 400/88
2007/0236735 A1* 10/2007 Reed ..... B41J 3/36 358/1.18
2007/0237560 A1* 10/2007 Brown ..... B41J 3/36 400/88
2007/0263062 A1* 11/2007 Noe ..... B41J 3/36 347/109

(Continued)

FOREIGN PATENT DOCUMENTS

JP H10-35028 A 2/1998

*Primary Examiner* — Julian Huffman
(74) *Attorney, Agent, or Firm* — Fitch Even Tabin & Flannery LLP

(57) ABSTRACT

A print assisting device detects, from information on a captured image including a first reference marker for a manual scanning type printing device and a second reference marker of a print medium on which the printing device is placed, information on the first and the second reference marker, and creates, as information on an assisting image, based on the information on the first and second reference markers and information on a contents to be printed by the printing device, at least any one of information on a first image of the contents that is printed in a case where the printing device is scanned from a current position, information on a second image of the contents that is printed in a case where the printing device is scanned from a printing start position which is designated, and information on a third image to guide a position of the printing device to the printing start position, and causes a display device to display the assisting image superimposed on the captured image.

19 Claims, 12 Drawing Sheets

(56) References Cited

U.S. PATENT DOCUMENTS

| | | | | |
|---|---|---|---|---|
| 2007/0285682 | A1* | 12/2007 | Lutnesky | B41J 3/36 358/1.8 |
| 2008/0075512 | A1* | 3/2008 | Gates | B41J 3/36 400/88 |
| 2017/0136764 | A1* | 5/2017 | Norasak | B41J 2/04505 |
| 2017/0140255 | A1* | 5/2017 | Norasak | G06K 15/021 |

* cited by examiner

PRINT ASSISTING DEVICE, PRINTING DEVICE, PRINTING SYSTEM, DETERMINING METHOD, AND NON-TRANSITORY COMPUTER READABLE RECORDING MEDIUM

CROSS-REFERENCE TO RELATED APPLICATION

This application claims the benefit of Japanese Patent Application No. 2016-060926, filed on Mar. 24, 2016, the entire disclosure of which is incorporated by reference herein.

FIELD

This application relates generally to a print assisting device, a printing device, a printing system, a determining method, and a non-transitory computer readable recording medium.

BACKGROUND

Manual scanning type printing devices are known which have a casing held by a user to manually scan, thereby printing contents, such as a letter, a symbol, a logo, a character, and a marking, on a print medium. For example, Unexamined Japanese Patent Application Kokai Publication No. H10-35028 discloses such a type of printing device.

The manual scanning type printing device disclosed in Unexamined Japanese Patent Application Kokai Publication No. H10-35028 requires the user to estimate the entire length of the contents to be printed based on the number of letters in the contents, and the size of the letter, and the like, and to adjust the printing start position.

This does not help the user to place the printing device to the precise printing start position in order to print the contents at the desired position.

SUMMARY

According to the present disclosure, an advantageous effect is accomplishable such that a printing assist device, a printing device, a printing system, a determining method, and a non-transitory computer readable recording medium are provided which are capable of facilitating a user to place a manual scanning type printing device at an appropriate printing start position.

In order to accomplish the above advantageous effect, a printing assist device according to an aspect of the present disclosure includes:

an imaging device;

a notifier including a display device; and a processor, wherein the processor:

obtains information on a captured image captured by the imaging device, the captured image including a first reference marker of a printing device being a manual scanning type and a second reference marker of a print medium on which the printing device is placed;

detects information on the first reference marker and information on the second reference marker from the information on the captured image;

creates, as an assisting image, at least any one of (1) a first image which is an image of contents that is printed by the printing device on the print medium in a case where the printing device is scanned from a current position of the printing device obtained from the information on the first reference marker, (2) a second image which is an image of the contents that is printed by the printing device on the print medium in a case where the printing device is scanned from a printing start position where the printing device prints the contents at a printing designated position obtained from the information on the second reference marker and information on the contents, and (3) a third image to guide a position of the printing device to the printing start position; and causes the display device to display the assisting image superimposed on the captured image.

In order to accomplish the above advantageous effect, a printing device according to a second aspect of the present disclosure includes:

a printing head that prints a contents on a print medium while moving on the print medium;

a casing provided with, on an outer surface, a first reference marker indicating a placed position of the printing device and a to-be-moved direction of the printing device;

a communicator that receives, from a print assisting device different from the printing device, information on a captured image of a second reference marker of the print medium and the first reference marker;

a notifier; and a processor, wherein the processor:

detects information on the first reference marker and information on the second reference marker from the information on the captured image;

determines, based on a print position and a printing designated position, the print position being a position of a contents that is printed by the printing head on the print medium in a case where the printing device is scanned from a current position of the printing device obtained from the information on the first reference marker, and the printing designated position being a position obtained from the information on the second reference marker and the information on the contents, whether or not the printing device is placed at a printing start position where the printing head prints the contents at the printing designated position; and causes the notifier to give a notification indicating that a start of a printing by the printing head is enabled and sets the printing device to be in a status capable of printing by the printing head in a case where the processor determines that the printing device is placed at the printing start position.

In order to accomplish the above advantageous effect, a printing device according to a third aspect of the present disclosure includes:

a printing head that prints a contents on a print medium while moving on the print medium;

a casing provided with, on an outer surface, a first reference marker indicating a placed position of the printing device and a to-be-moved direction;

a communicator that receives, from a print assisting device different from the printing device, information indicating whether or not the printing device is placed at a printing start position where the contents is printed at a preset printing designated position by the printing device, the information being determined based on a captured image of the print medium and the printing device placed on the print medium;

a notifier; and a processor, wherein the processor causes the notifier to give a notification indicating that a start of a printing is enabled by the printing head and causes the printing device to be in a status capable of printing by the printing head in a case where the printing device receives information indicating that the printing device is placed at the printing start position via the communicator from the print assisting device.

In order to accomplish the above advantageous effect, a printing system according to a fourth aspect of the present disclosure includes:

a printing device being a manual scanning type; and a print assisting device, wherein:

the printing device comprises a printing head that prints a contents on a print medium while moving on the print medium, a casing provided with, on an outer surface, a first reference marker indicating a placed position of the printing device and a to-be-moved direction of the printing device, a first communicator that communicates information with the print assisting device, and a first processor;

the print assisting device comprises an imaging device, a notifier, a second communicator that communicates the information with the printing device, and a second processor;

the second processor of the print assisting device:

obtains information on a captured image captured by the imaging device, the captured image including a first reference marker of the printing device and a second reference marker of the print medium on which the printing device is placed;

detects information on the first reference marker and information on the second reference marker from the information on the captured image;

creates (1) a first image which is an image of contents that is printed by the printing device on the print medium in a case where the printing device is scanned from a current position of the printing device obtained from the information on the first reference marker, and (2) a second image which is an image of the contents that is printed by the printing device on the print medium in a case where the printing device is scanned from a printing start position where the printing device prints the contents at a printing designated position obtained from the information on the second reference marker and information on the contents;

determines, based on the first image and the second image, whether or not the printing device is placed at the printing start position where the contents is printed at the printing designated position, causes the notifier to give a notification indicating that a start of a printing by the printing device is enabled, and transmits, to the printing device via the second communicator, information indicating that the start of the printing is enabled; and the first processor of the printing device sets the printing device to be in a status capable of printing by the printing head in a case where the printing device receives the information from the print assisting device via the first communicator that the start of the printing is enabled.

In order to accomplish the above objective, a printing system according to a fifth aspect of the present disclosure includes:

a printing device being a manual scanning type; and a print assisting device, wherein:

the printing device comprises a printing head that prints a contents on a print medium while moving on the print medium, a casing provided with, on an outer surface, a first reference marker indicating a placed position of the printing device and a to-be-moved direction of the printing device, a first communicator that communicates information with the print assisting device, a notifier, and a first processor;

the print assisting device comprises an imaging device and a second communicator that communicates the information with the printing device;

the print assisting device transmits, via the second communicator, information on a captured image obtained by imaging the first reference marker of the printing device and a second reference marker of the print medium where the printing device is placed by the imaging device;

the printing device receives, via the first communicator, the information on the captured images transmitted from the print assisting device;

the processor of the printing device:

detects information on the first reference marker and information on the second reference marker from the information on the captured images;

determines, based on a print position and a printing designated position, the print position being a position of an image of a contents that is printed by the printing head on the print medium in a case where the printing head is scanned from a current position of the printing device obtained from the information on the first reference marker, and the printing designated position being a position obtained from the information on the second reference marker and the information on the contents, whether or not the printing device is placed at a printing start position where the printing head prints the contents at the printing designated position; and causes the notifier to give a notification indicating that a start of a printing by the printing device is enabled and sets the printing device to be in a status capable of printing by the printing head in a case where the processor determines that the printing device is placed at the printing start position.

In order to accomplish the above objective, a determining method according to a sixth aspect of the present disclosure includes:

obtaining information on a captured image captured by an imaging device, the captured image including a first reference marker of a printing device being a manual scanning type and a second reference marker of a print medium on which the printing device is placed;

detecting information on the first reference marker and information on the second reference marker from the information on the captured image; and determining, based on a print position and a printing designated position, the print position being a position of a contents that is printed by the printing device on the print medium in a case where the printing device is scanned from a current position of the printing device obtained from the information on the first reference marker, and the printing designated position being a position obtained from the information on the second reference marker and the information on the contents, whether or not the printing device is placed at a printing start position where the printing device prints the contents at the printing designated position.

In order to accomplish the above objective, a non-transitory computer readable recording medium according to a seventh aspect of the present disclosure and having stored therein a notification control program, the notification control program causing a computer to:

obtain information on a captured image captured by an imaging device, the captured image including a first reference marker of a printing device being a manual scanning type and a second reference marker of a print medium on which the printing device is placed;

detect information on the first reference marker and information on the second reference marker from the information on the captured image; and determine, based on a print position and a printing designated position, the print position being a position of a contents that is printed by the printing device on the print medium in a case where the printing device is scanned from a current position of the printing device obtained from the information on the first reference marker, and the printing designated position being a position obtained from the information on the second reference marker and the information of the contents, whether or not the printing device is placed at a printing start position where the printing device prints the contents at the printing designated position.

BRIEF DESCRIPTION OF THE DRAWINGS

A more complete understanding of this application can be obtained when the following detailed description is considered in conjunction with the following drawings, in which.

DETAILED DESCRIPTION

A print assisting device, a printing device, a printing system, a determining method, and a non-transitory computer readable recording medium according to an embodiment of the present disclosure will be explained in detail below with reference to the accompanying figures.

A printing system 1 according to an embodiment is to print an image of contents, such as a letter, a symbol, a logo, a character, a marking and a pattern (hereinafter, those are collectively referred to as a contents) on a print medium R.

Figure 1A:
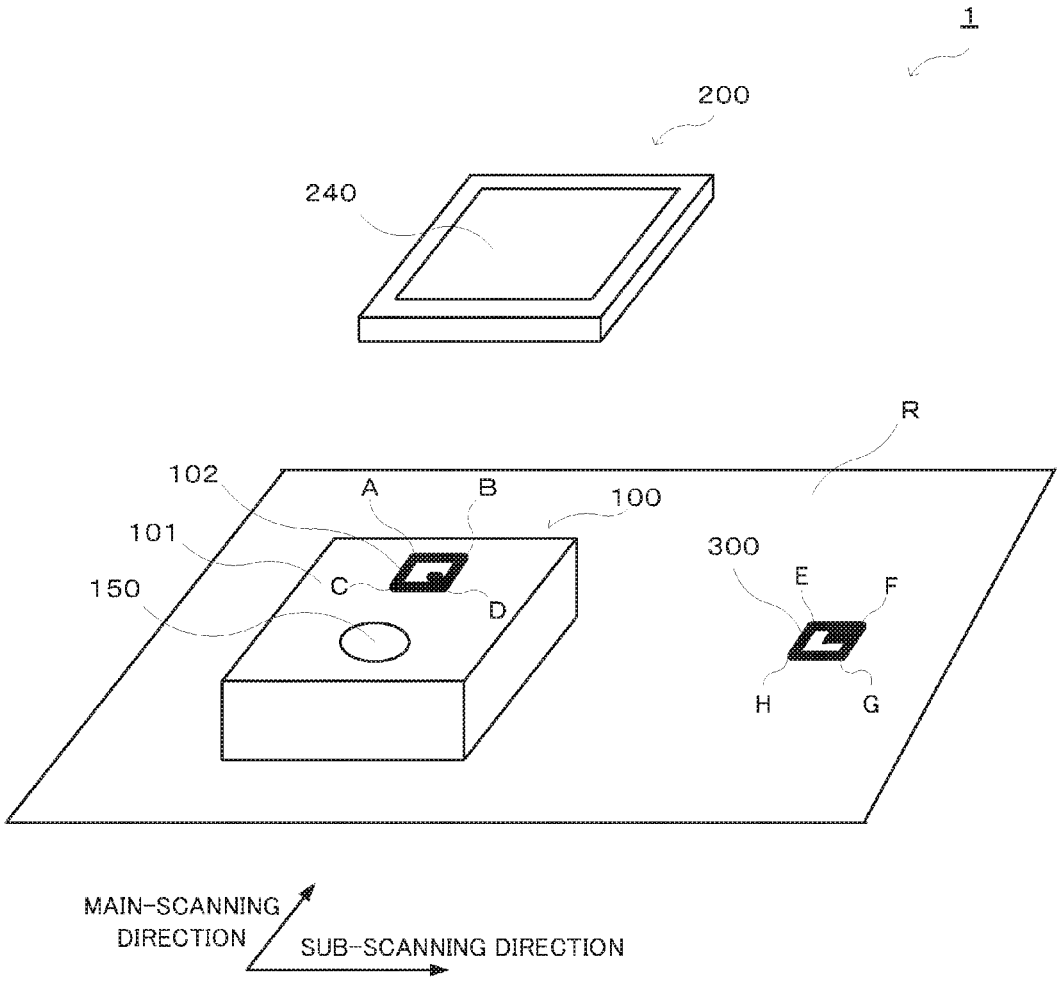
FIG. 1A is a diagram illustrating a printing system according to an embodiment of the present disclosure.
Figure 1B:
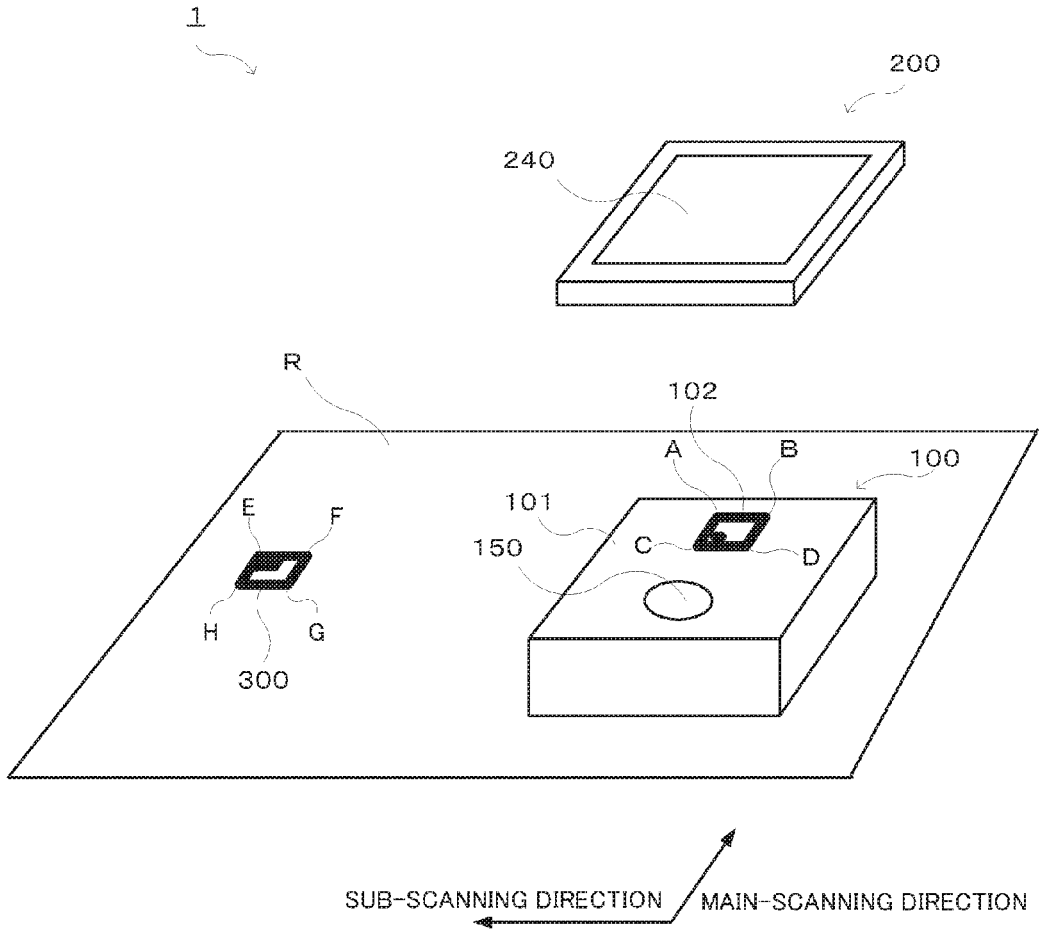
FIG. 1B is another diagram illustrating the printing system according to the embodiment of the present disclosure.

As illustrated in FIGS. 1A, 1B, the printing system 1 includes a handy printer (manual scanning type printing device) 100 which scans (is moved) over the print medium R by a user, and which prints the contents on the print medium R, and a terminal device (print assisting device) 200 that includes a display device 240.

In the following explanation, the terms "up", "down", "right", and "left" will be referred as appropriate which correspond to the up, down, right and left directions in FIG. 1A except a case in which a particular notation is given.

The terminal device 200 is, for example, a smartphone, or a tablet type Personal Computer (PC).

The handy printer 100 and the terminal device 200 are mutually communicable via a wireless communication.

The terminal device 200 functions as an Augmented Reality (AR) display device. The terminal device 200 displays assisting images I1, I2, and I3 which guide the user to move the handy printer 100 to a position specified based on a first reference marker 102 provided on the handy printer 100, a second reference marker 300 disposed on the print medium R, and the contents to be printed on the print medium R, and which is a printing start position where the printing starts.

The terminal device 200 further notifies the user of whether or not the handy printer 100 is placed at the appropriate printing start position. In a case where the first reference marker 102 and the second reference marker 300 are in the form as illustrated in FIG. 1A, the printing start position for printing is a position where the right end of the contents contacts the left end of the second reference marker 300 in the figure, and in a case where the first reference marker 102 and the second reference marker 300 are in the form as illustrated in FIG. 1B, the printing start position is a position where the left end of the contents contacts the right end of the second reference marker 300 in the figure.

In this case, the first reference marker 102 has a stationary disposed position relative to the handy printer 100, is provided at a position that enables an image-capture thereof from the upper space of the handy printer 100, and is, for example, provided stationary on the upper surface of the handy printer 100. The position of the first reference marker 102 is shifted together with the scanning (movement) by the handy printer 100.

The second reference marker 300 has a stationary disposed position relative to the print medium R, and in a case where the handy printer 100 scans (is moved), the relative disposed position of the second reference marker 300 to the print medium R remains unchanged.

A casing 101 of the handy printer 100 has a dimension easy for the user to hold by the user's hand.

In a case where the user holds the handy printer 100, and scans (is moved) in the sub-scanning direction illustrated in FIG. 1A or 1B, the contents is printed on the print medium R along the sub-scanning direction.

Provided on the upper surface of the handy printer 100 are the first reference marker 102 for the terminal device 200 to detect the position, and the like, of the handy printer 100, and a start button 150 that accepts a printing start instruction.

The first reference marker 102 includes, for example, a square black frame, and a dot which is disposed near a vertex D within the black frame, and which indicates the main-scanning direction and the sub-scanning direction (to-be-moved direction).

A line segment that interconnects a vertex A and a vertex B both within the black frame and a line segment that interconnects a vertex C and a vertex D are provided in parallel with the sub-scanning direction.

A line segment that interconnects the vertex A and the vertex C both within the black frame and a line segment that interconnects the vertex B and the vertex D are provided in parallel with the main-scanning direction.

In this case, as illustrated in FIG. 1A, in a case where the dot that indicates the sub-scanning direction (to-be-moved direction) is provided at the lower right position within the black frame, the main-scanning direction becomes the upper direction, while the sub-scanning direction becomes the right direction.

Conversely, as illustrated in FIG. 1B, in a case where the dot that indicates the sub-scanning direction (to-be-moved direction) is provided at the lower left position within the black frame, the main-scanning direction becomes the upper direction, while the sub-scanning direction becomes the left direction.

In the following explanation, an explanation will be given of an example case in which the first reference marker 102 and the second reference marker 300 are in the form as illustrated in FIG. 1A.

Figure 2:
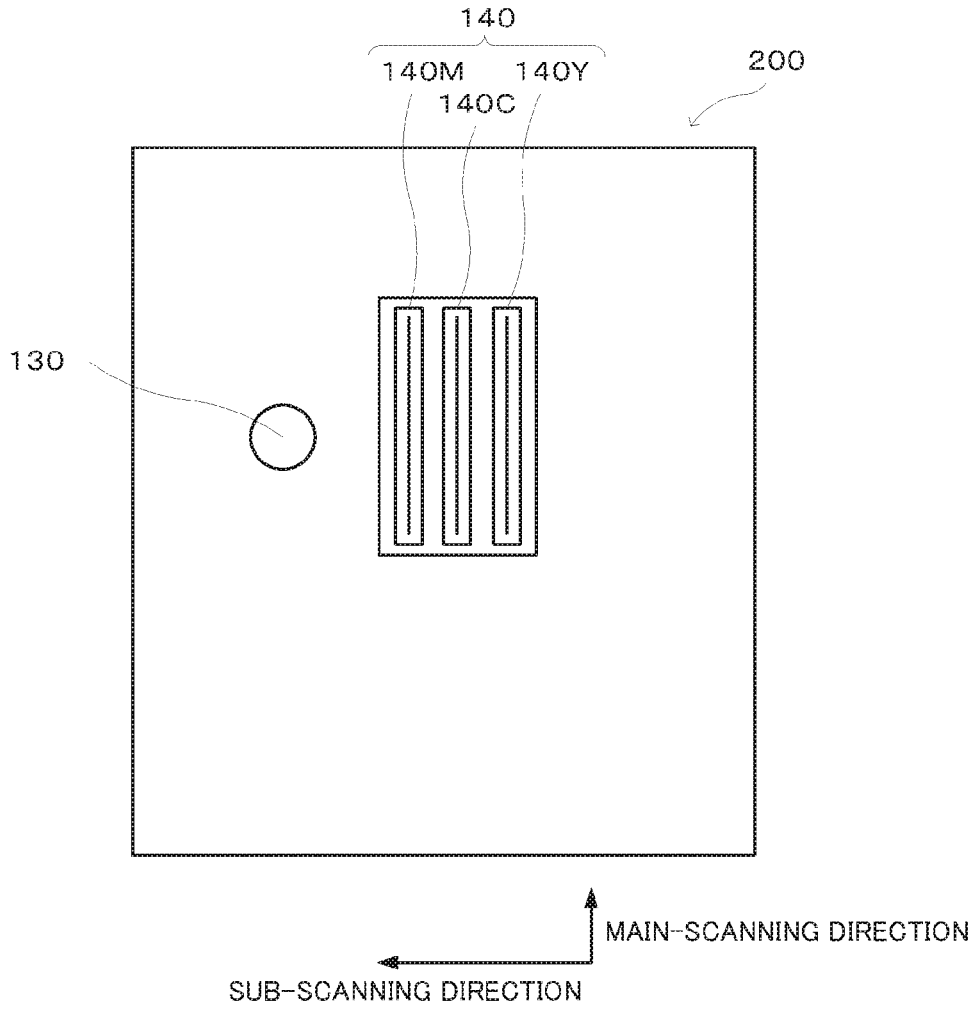
FIG. 2 is a bottom view illustrating a handy printer according to the embodiment of the present disclosure.

As illustrated in FIG. 2, provided on the bottom surface of the handy printer 100 are a scanning-distance detector 130 and a printing head (printer) 140. The scanning-distance detector 130 and the printing head 140 are fastened to the bottom surface of the handy printer 100, and are moved together with the handy printer 100.

The scanning-distance detector 130 includes, for example, a light source like a Light Emitting Diode (LED), and an optical sensor, and detects, relative to the print medium R, a relative scanning distance (moved distance) of the handy printer 100 (that is, the printing head 140), while the handy printer 100 relatively scans (is moved) in the sub-scanning direction for each predetermined time pitch.

The printing head 140 includes a magenta printing head 140M that discharges a magenta ink, a cyan printing head 140C that discharges a cyan ink, a yellow printing head 140Y that discharges a yellow ink, and unillustrated ink tanks for the respective colors.

Each of the printing heads 140M, 140C, and 140Y is provided with multiple nozzles which are provided side by side in a line along the main-scanning direction, and which respectively discharge the inks. Each nozzle is exposed from the bottom surface of the handy printer 100. Note that the main-scanning direction is orthogonal to the sub-scanning direction.

The printing head 140 selectively discharges the ink from the respective types of nozzles upon signal carrying corresponding to the contents.

Figure 3:
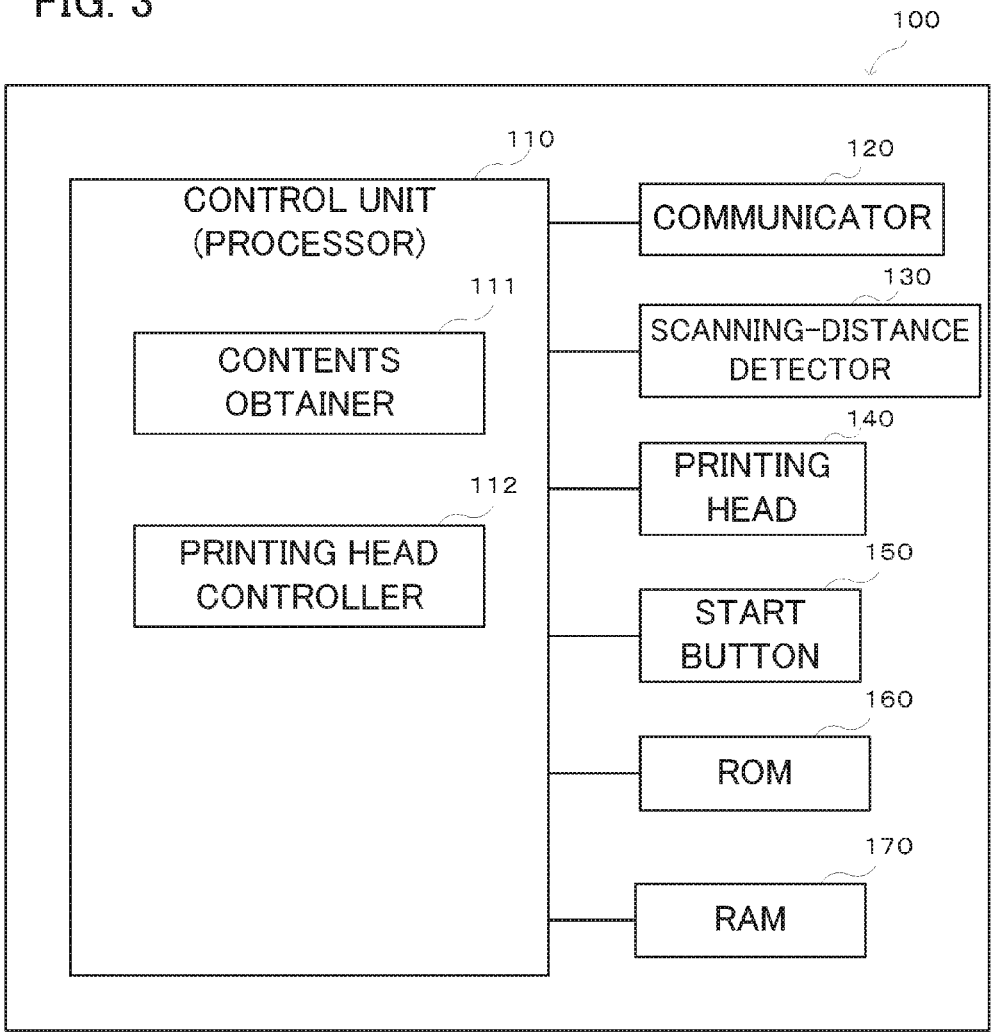
FIG. 3 is a block diagram illustrating a structure of the handy printer according to the embodiment of the present disclosure.

As an electrical structure, as illustrated in FIG. 3, the handy printer 100 includes the scanning-distance detector 130, the printing head 140, and the start button 150 all explained above, and further a control unit (processor) 110, a communicator (second communicator) 120, a Read Only Memory (ROM) 160, and a Random Access Memory (RAM) 170.

The control unit (processor) 110 includes a Central Processing Unit (CPU).

The control unit 110 functions as a contents obtainer 111, and a printing head controller 112 upon executing the program stored in the ROM 160.

The contents obtainer 111 obtains data indicating the contents transmitted from the terminal device 200 via the communicator 120, and stores the data in the RAM 170.

The printing head controller 112 controls the printing head 140 based on the scanning distance of the handy printer 100 which is for each predetermined time pitch while the handy printer 100 is scanning in the sub-scanning direction, and which is detected by the scanning-distance detector 130, and causes the printing head 140 to print the contents on the print medium R.

More specifically, while the handy printer 100 is scanning in the sub-scanning direction relative to the print medium R, every time the printing head 140 is moved by a distance by what corresponds to a 1-dot pitch in the sub-scanning direction relative to the print medium R, the printing head controller 112 causes the printing head 140 to print, on the print medium R, a 1-dot line having individual pixels arranged side by side in a line in the main-scanning direction of the stored contents in the RAM 170.

The printing head controller 112 transmits, via the communicator 120, information indicating the start of printing to the terminal device 200 in a case where the printing starts.

The communicator 120 receives data on the contents from the terminal device 200, and transmits data indicating the scanning distance for each predetermined time pitch to the terminal device 200.

The communicator 120 includes a wireless communication module, such as a wireless Local Area Network (LAN) or Bluetooth (Registered Trademark).

As explained above, while the handy printer 100 is scanning in the sub-scanning direction relative to the print medium R, the scanning-distance detector 130 detects the scanning distance of the printing head 140 for each predetermined time pitch, and outputs data indicating the detected scanning distance for each predetermined time pitch to the printing head controller 112.

As explained above, the printing head 140 selectively discharges the inks from the multiple nozzles of the printing head 140 in accordance with print data under the control by the printing head controller 112.

The discharged inks from the respective nozzles of the printing head 140 stick to the print medium R. Hence, pixels (1-dot line) arranged side by side in a line in the main-scanning direction of the printing head 140 are printed.

The start button 150 accepts an instruction to start printing based on the user control.

The ROM 160 includes a non-volatile memory like a flash memory, and stores the program to accomplish the various functions by the control unit 110 as explained above. The RAM 170 includes a volatile memory, and is utilized as a work area for the control unit 110 to execute the program for the various processes.

The RAM 170 stores information, such as the YMC image data to be printed, and scanning distance.

Figure 4:
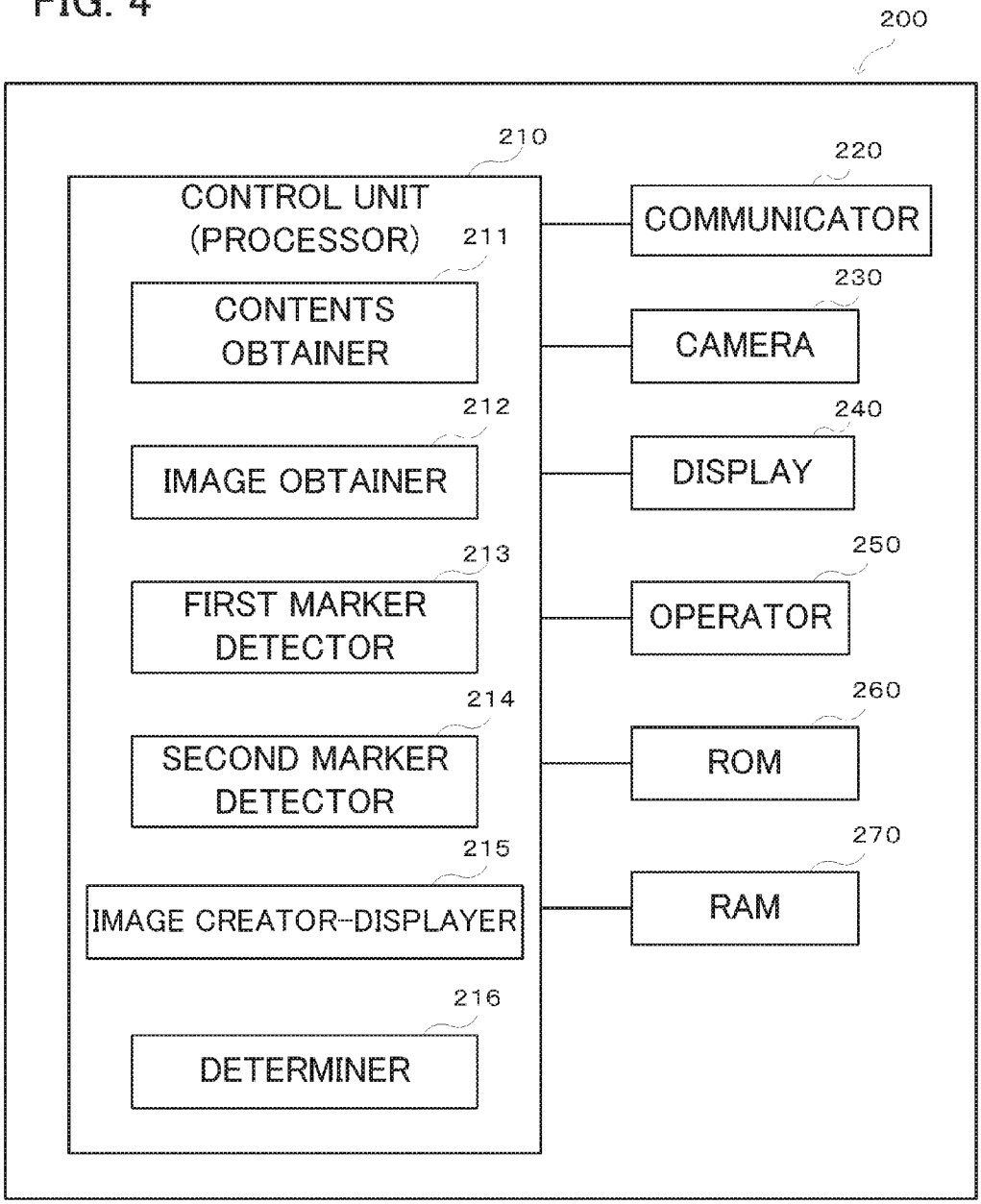
FIG. 4 is a block diagram illustrating a structure of a terminal device according to the embodiment of the present disclosure.

The terminal device 200 illustrated in FIGS. 1A, 1B includes, as illustrated in FIG. 4, a control unit (processor) 210, a communicator (first communicator) 220, a camera (imaging device) 230, a display device 240, an operator 250, a ROM 260, and a RAM 270.

The control unit (processor) 210 includes a CPU.

The control unit 210 functions as a contents obtainer 211, an image obtainer 212, a first marker detector 213, a second marker detector 214, an image creator-displayer 215, and a determiner 216 by executing the program stored in the ROM 260.

The contents obtainer 211 obtains image data corresponding to the contents accepted by the operator 250, or image data corresponding to the contents received by the communicator 220.

The contents obtainer 211 transmits, via the communicator 220, the obtained contents data to the handy printer 100.

The image obtainer 212 obtains image data on the image of the real space captured by the camera 230, stores the obtained image data in the RAM 270, and displays the image of the real space captured by the camera 230 on the display device 240 as a live-view image LI.

In a case where the camera 230 picks up the image of the handy printer 100 and that of the print medium R from the upper space, and the handy printer 100 is contained in the live-view image LI, the first marker detector 213 detects, from the image of the handy printer 100 contained in the live-view image LI, the first reference marker 102 disposed on the handy printer 100.

The first marker detector 213 specifies, based on the first reference marker 102, the position of the handy printer 100 in the image and the sub-scanning direction (to-be-moved direction) thereof in the image.

For example, the first marker detector 213 determines whether or not the first reference marker 102 matching the image pattern of the first reference marker 102 stored in the ROM 206 beforehand is contained in the live-view image LI.

The first marker detector 213 recognizes vertices of the first reference marker 102 illustrated in FIGS. 1A, 1B at the four corners (vertices A, B, C, and D) in a case where determining that the first reference marker 102 is contained in the live-view image LI.

The first marker detector 213 detects the position of the first reference marker 102 contained in the live-view image LI from the positions of the vertices at the four corners, and specifies the position of the handy printer 100 from the position of the first reference marker 102.

The first marker detector 213 specifies the sub-scanning direction (to-be-moved direction) of the handy printer 100 within the live-view image LI based on an angle formed between a line segment AB and a line segment AC, a ratio between the length of the line segment AB and that of a line segment CD, the direction of the line segment AB, and the like.

The upper, lower, right and left directions of the first reference marker 102 are recognized based on, in the case of the embodiment illustrated in FIG. 1A, a marking indicating the lower right side given near the vertex D. In the case of the embodiment illustrated in FIG. 1B, those directions are recognized based on a marking indicating the lower left side given near the vertex C.

The second marker detector 214 detects the second reference marker 300 disposed on the print medium R contained in the live-view image LI which is the image of the real space captured by the camera 230, that is, the position other than the handy printer 100.

The second marker detector 214 further specifies the printing designated position to print the contents on the print medium R based on the position of the second reference marker 300 and the contents image.

For example, the second marker detector 214 determines whether or not the second reference marker 300 matching with the image pattern of the second reference marker 300 stored in the ROM 260 beforehand is contained in the live-view image LI.

As illustrated in FIGS. 1A, 1B, the second reference marker 300 is formed in a square shape, and includes a black frame that is blacked out other than the white region in the L shape, and the white region in the white L shape.

In a case where, for example, determining that the live-view image LI contains the second reference marker 300, the second marker detector 214 recognizes the vertices (vertex E, verted F, vertex G, and vertex H) at the four corners of the black frame of the second reference marker 300.

The second marker detector 214 detects, like the first marker detector 213, the position of the second reference marker 300 contained in the live-view image LI based on the positions of the vertices at the four corners, and specifies the printing designated position where the contents image is to be printed based on the position of the reference marker 300, and the contents image.

The up, down, right, and left sides of the second reference marker 300 are recognized based on the direction of the L-shaped white region.

Returning to FIG. 4, the image creator-displayer 215 creates information on assisting images I1, I2, and I3 based on the information on the contents to be printed, information on the position of the handy printer 100 and the sub-scanning direction thereof both indicated by the first reference marker 102, and the information on the position of the second reference marker 300.

Next, the image creator-displayer 215 lays over the assisting images I1, I2, and I3 on the image of the real space, and displays the laid-over image.

More specifically, the image creator-displayer 215 creates the information on the first assisting image I1 that is a printing preview image if the contents is to be printed in the sub-scanning direction from the position where the handy printer 100 is presently placed based on the contents to be printed, and the position and the sub-scanning direction both indicated by the first reference marker 102.

Next, the image creator-displayer 215 creates the information on the second assisting image I2 that is a printing preview image if the contents is to be printed along the sub-scanning direction on the printing designated position based on the contents and the position of the second reference marker 300.

Still further, the image creator-displayer 215 creates the information on the third assisting image I3 that is, for example, an arrow indicating the direction for moving the handy printer 100 to an appropriate printing start position from the presently placed position of the handy printer 100 in order to accomplish the proper printing start position where the first assisting image I1 and the second assisting image I2 are laid over.

Next, the image creator-displayer 215 displays, on the display device 240, the created first to third assisting images I1, I2, and I3 in a manner laid over on the live-view image LI.

The determiner 216 determines, in a case where the handy printer 100 starts the printing from the presently placed position, whether or not the printing completes at the position of the left end of the second reference marker 300.

More specifically, the determiner 216 determines, based on whether or not the first assisting image I1 and the second assisting image I2 both created by the image creator-displayer 215 overlap with each other, whether or not the printing completes at the position of the left end of the second reference marker 300 in a case where the printing starts from the presently placed position of the handy printer 100.

The determiner 216 displays this determination result on the display device 240.

In a case where the first assisting image I1 and the second assisting image I2 overlap with each other, the determiner 216 transmits information indicating that the start of printing is enabled to the handy printer 100 via the communicator 220.

The communicator 220 transmits image data corresponding to the contents to the handy printer 100, and receives the data indicating the scanning distance transmitted from the handy printer 100.

The communicator 220 includes a wireless communication module, such as a wireless LAN or Bluetooth (Registered Trademark) like the above communicator 120.

The camera 230 is an imaging device that picks up the image of the real space.

The camera 230 includes a lens, an imaging element, and the like, and outputs the image data on the captured image to the control unit 210.

The imaging element is, for example, a Complementary Metal Oxide Semiconductor (CMOS) image sensor.

The display device 240 is a notifier that includes a display part to display the image created by the image creator-displayer 215, and the necessary image for the user control, and includes, for example, a Liquid Crystal Display (LCD), an organic electroluminescence display, or other types of flat display.

The operator 250 accepts, for example, the contents, and the instructions to start and end the printing process based on the user input and control.

Note that the operator 250 and the display device 240 may construct a touch panel display device.

The ROM 260 includes a non-volatile memory like a flash memory, and stores the program to accomplish various functions by the control unit 210, the pattern of the first reference marker 102, and the pattern of the second reference marker 300, and the like.

The RAM 270 includes a volatile memory, and is utilized as a work area for the control unit 210 to execute the program for the various processes.

The RAM 270 further stores the image data on the live-view image LI of the real space captured by the camera 230, and the image data corresponding to the contents.

Next, an explanation will be given of the printing assist process to be executed by the terminal device 200 employing the above structure.

The terminal device 200 displays, on the display device 240 in a manner laid over on the live-view image LI, the first assisting image I1 indicating the printing preview if the contents to be printed is printed by the user using the handy printer 100, the second assisting image I2 indicating the printing preview based on the second reference marker 300, and the third assisting image I3 indicating the arrow to move the handy printer 100 prior to the start of printing so as to enable the printing on the position of the second assisting image I2.

The terminal device 200 determines, in a case where the handy printer 100 starts the printing at the presently placed position, whether or not the printing completes at the position of the left end of the second reference marker 300. In addition, the terminal device 200 displays this determination result on the display device 240.

Hence, the user is capable of easily knowing from which position the handy printer 100 should start the printing by viewing the displayed information on the display device 240.

Figure 5:
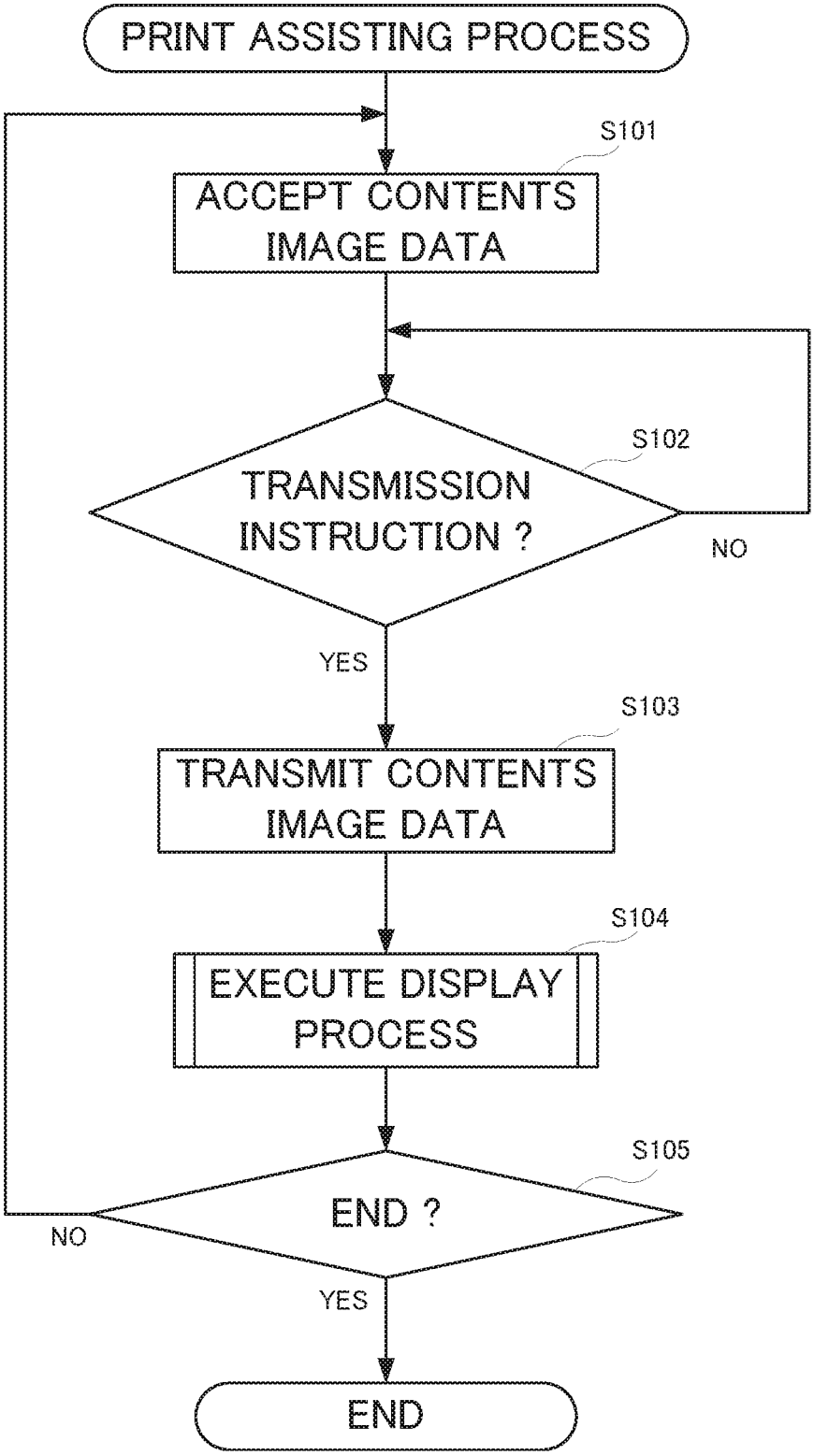
FIG. 5 is a flowchart illustrating a print assisting process executed by the terminal device according to the embodiment of the present disclosure.

The terminal device 200 starts a printing assist process illustrated in FIG. 5 in response to the instruction to start the printing control process given by the user.

The user disposes a piece on which the second reference marker is printed at the position of the right end of the position where the contents is to be printed in such a way that the second reference marker 300 can be viewed from the upper space.

The printing assist process to be executed by the terminal device 200 will be explained below with reference to a flowchart.

First, the contents obtainer 211 accepts (step S101) the image data corresponding to the contents to be printed, and input by the user via the operator 250.

The contents obtainer 211 stores the image data corresponding to the accepted contents in the RAM 270.

Next, the contents obtainer 211 determines (step S102) whether or not an instruction to transmit the corresponding image data to the contents is accepted.

When the instruction to transmit the corresponding image data to the contents has not been accepted yet (step S102: NO), the process in the step S102 is repeated.

When the instruction to transmit the corresponding image data to the contents is accepted (step S102: YES), the contents obtainer 211 transmits (step S103), to the handy printer 100 via the communicator 220, the corresponding image data to the contents.

Next, the control unit 210 executes a displaying process (step S104).

Figure 6:
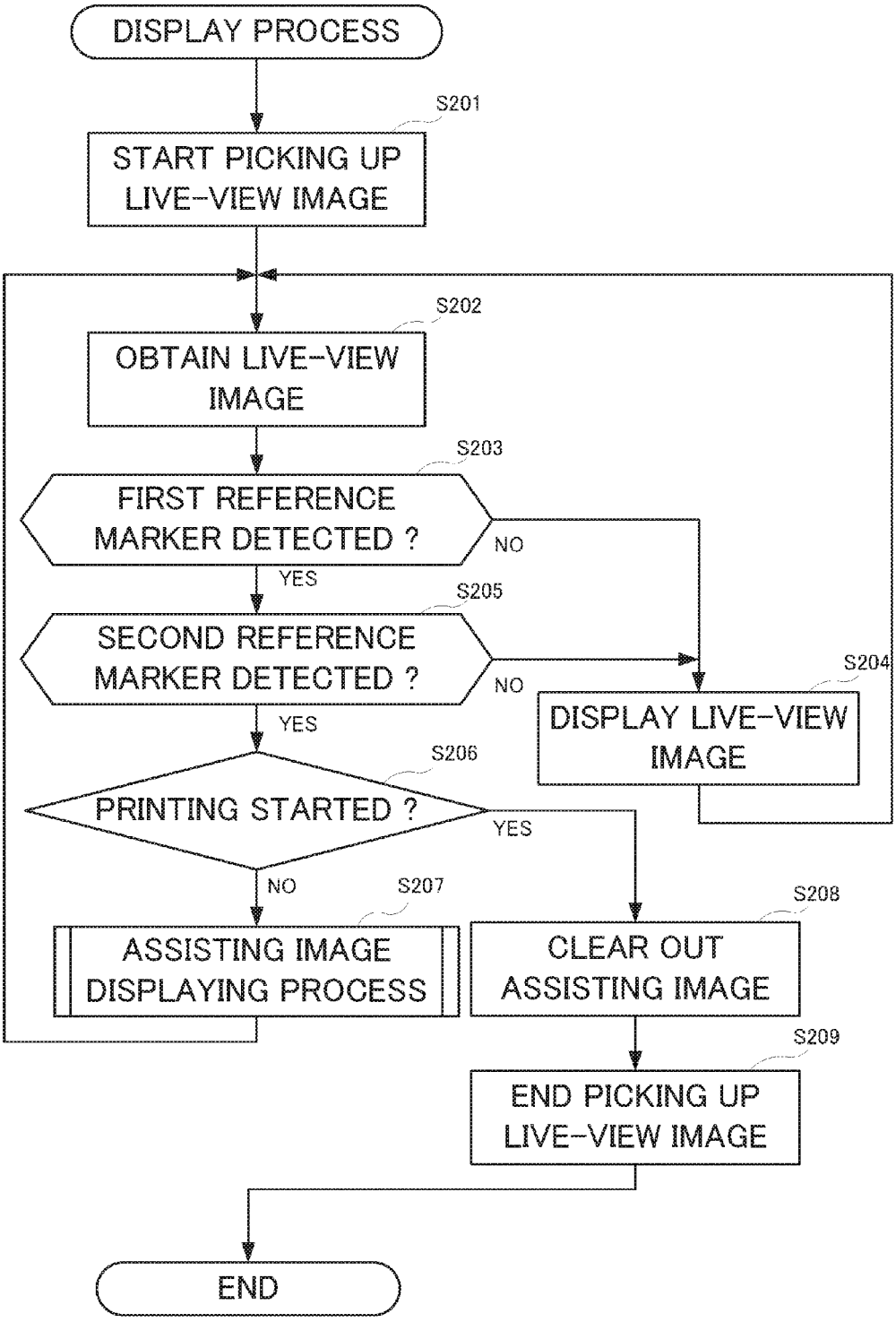
FIG. 6 is a flowchart illustrating a displaying process executed by the terminal device according to the embodiment of the present disclosure.

In the displaying process, as illustrated in FIG. 6, the image obtainer 212 causes the camera 230 to start (step S201) picking up the live-view image LI of the real space.

In this case, the user directs the camera 230 toward the handy printer 100 and the print medium R.

Next, the image obtainer 212 obtains (step S202) the image data on the live-view image LI, and stores the obtained image data in the RAM 270.

Subsequently, the first marker detector 213 determines (step S203) whether or not the live-view image LI contains the image pattern matching with the image pattern of the first reference marker 102 stored in the ROM 260 beforehand.

In a case where the first marker detector 213 determines (step S203: NO) that the live-view image LI does not contain the image pattern of the first reference marker 102, the live-view image LI is displayed (step S204) on the display device 240, and the process returns to the step S202.

In a case where the first marker detector 213 determines (step S203: YES) that the live-view image LI contains the image pattern of the first reference marker 102, the second marker detector 214 determines (step S205) whether or not the live-view image LI contains the image pattern matching with the image pattern of the second reference marker 300 stored in the ROM 260 beforehand.

In a case where the second marker detector 214 determines (step S205: NO) that the live-view image LI does not contain the image pattern of the second reference marker 300, the live-view image LI is displayed (step S204) on the display device 240, and the process returns to the step S202.

In a case where the second marker detector 214 determines (step S205: YES) that the live-view image LI contains the image pattern of the second reference marker 300, the determiner 216 determines (step S206) whether or not the handy printer 100 has started printing.

In a case where the determiner 216 determines (step S206: NO) that printing has not started yet, the image creator-displayer 215 executes an assisting image displaying process (step S207).

Figure 7:
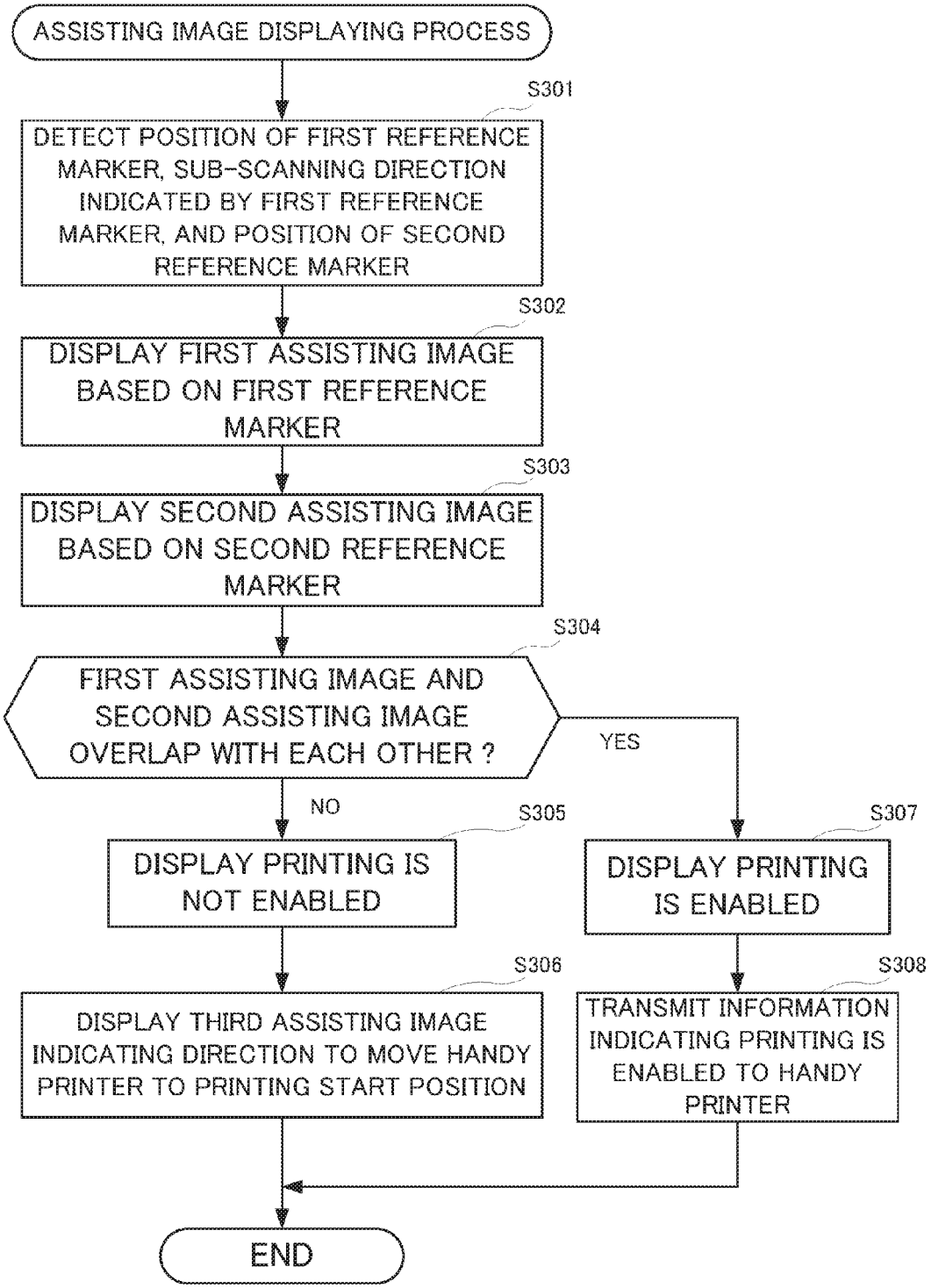
FIG. 7 is a flowchart illustrating an assisting image displaying process executed by the terminal device according to the embodiment of the present disclosure.

In the assisting image displaying process, as illustrated in FIG. 7, the first marker detector 213 detects the position of the first reference marker 102 contained in the live-view image and the sub-scanning direction indicated by the first reference marker 102. Next, the second marker detector 214 detects (step S301) the position of the second reference marker 300.

The first marker detector 213 recognizes, for example, the vertices (vertex A, vertex B, vertex C, and vertex D) at the four corners of the first reference marker 102 illustrated in FIGS. 1A, 1B, and detects the position of the first reference marker 102 based on the positions of those vertices.

The first marker detector 213 further detects the sub-scanning direction indicated by the first reference marker 102 based on the direction of the line segment interconnecting the vertex A with the vertex B, and the like.

The second marker detector 214 detects the position of the second reference marker 300 like the first marker detector 213.

Returning to FIG. 7, the image creator-displayer 215 creates the information on the first assisting image I1 indicating the printing preview if the printing of the contents starts from the presently placed position of the handy printer 100 along the sub-scanning direction based on the information on the position of the first reference marker 102 and on the sub-scanning direction. In addition, this first assisting image I1 displayed (step S302) on the display device 240 in a manner laid over on the live-view image LI.

Next, the image creator-displayer 215 creates the information on the second assisting image I2 indicating the printing preview if the printing of the contents starts up to the left end position of the second reference marker 300 along the sub-scanning direction based on the information on the position of the second reference marker 300. In addition, this second assisting image I2 is displayed (step S303) on the display device 240 in a manner laid over on the live-view image LI.

Subsequently, the determiner 216 determines (step S304) whether or not the first assisting image and the second assisting image I2 overlap with each other.

More specifically, the determiner 216 sets the minimum frame that surrounds the first assisting image and the minimum frame that surrounds the second assisting image I2. Next, in a case where the part surrounded by the frame that surrounds the first assisting image I1 overlaps the part surrounded by the frame that surrounds the second assisting image I2 by equal to or greater than a predetermined percentage, the determiner 216 determines that the first assisting image I1 and the second assisting image I2 overlap with each other. In this case, an example predetermined percentage is 80%.

In a case where the determiner 216 determines (step S304: NO) that the first assisting image I1 and the second assisting image I2 do not overlap with each other, the image creator-displayer 215 displays (step S305), on the display device 240, information IN1 indicating that the start of printing is not enabled yet.

Figure 9:
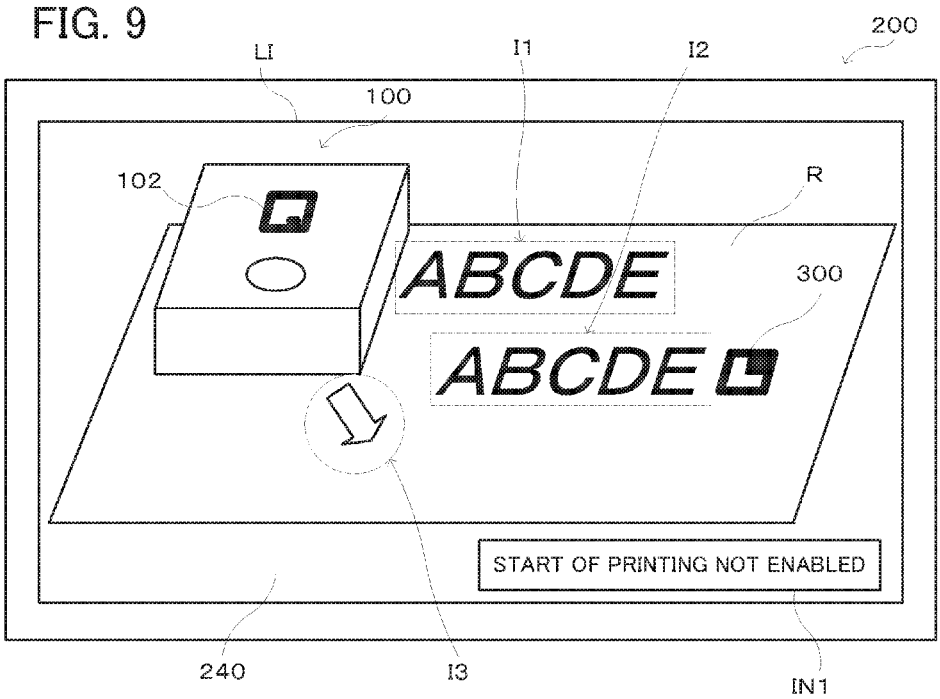
FIG. 9 is a diagram illustrating an example display scheme by a display device of the terminal device according to the embodiment of the present disclosure.

Next, the image creator-displayer 215 creates information on the third assisting image I3 indicating the direction to move the handy printer 100 to an appropriate printing start position. An example third assisting image I3 is an arrow as illustrated in FIG. 9.

Subsequently, this third assisting image I3 is displayed (step S306) on the display device 240.

In this case, the direction which is indicated by the third assisting image I3, and which is to move the handy printer 100 to an appropriate printing start position is a direction from the first assisting image I1 toward the second assisting image I2, and for example, an arrow directed in this direction is created as the third assisting image I3, and is displayed on the display device 240.

Next, the assisting image displaying process ends.

Subsequently, the process returns to the displaying process illustrated in FIG. 6, the processes from the step S202 to the step S207 are repeated, the pieces of information on the first to third assisting images I1, I2, and I3 are created based on the first reference marker 102 and the second reference marker 300 contained in the captured live-view image LI by the camera 230, and the created first to third assisting images I1, I2, and I3 are displayed on the display device 240.

In a case where the user moves the handy printer 100 in the direction indicated by the third assisting image I3, and the first assisting image I1 and the second assisting image I2 overlap with each other, in the assisting image displaying process illustrated in FIG. 7, the determiner 216 determines (step S304: YES) that the first assisting image I1 and the second assisting image I2 overlap with each other.

Subsequently, the image creator-displayer 215 displays (step S307), on the display device 240, information IN2 indicating that the start of printing is enabled.

Next, the determiner 216 transmits (step S308) information indicating that the start of printing is enabled to the handy printer 100, and ends the assisting image displaying process.

In a case where the assisting image displaying process ends, the process returns to the displaying process illustrated in FIG. 6.

Next, in a case where the user starts printing by the handy printer 100, information indicating that the printing is started is transmitted from the handy printer 100 to the terminal device 200, and the determiner 216 determines (step S206: YES) that the handy printer 100 has started the printing.

Subsequently, the image creator-displayer 215 clears out (step S208) the information on the assisting images, ends (step S209) the image-pickup of the live-view image LI, and also ends the displaying process.

In a case where the displaying process ends, the process returns to the print assisting process, and the contents obtainer 211 determines (step S105) whether or not an instruction to end the print assisting process is input.

In a case where the instruction to end the print assisting process has not been input (step S105: NO), the process returns to the step S101, and the processes from the step S101 to the step S105 are repeated.

In a case where the instruction to end the print assisting process is input (step S105: YES), the print assisting process ends.

Next, an explanation will be given of the printing process executed by the handy printer 100.

Figure 8:
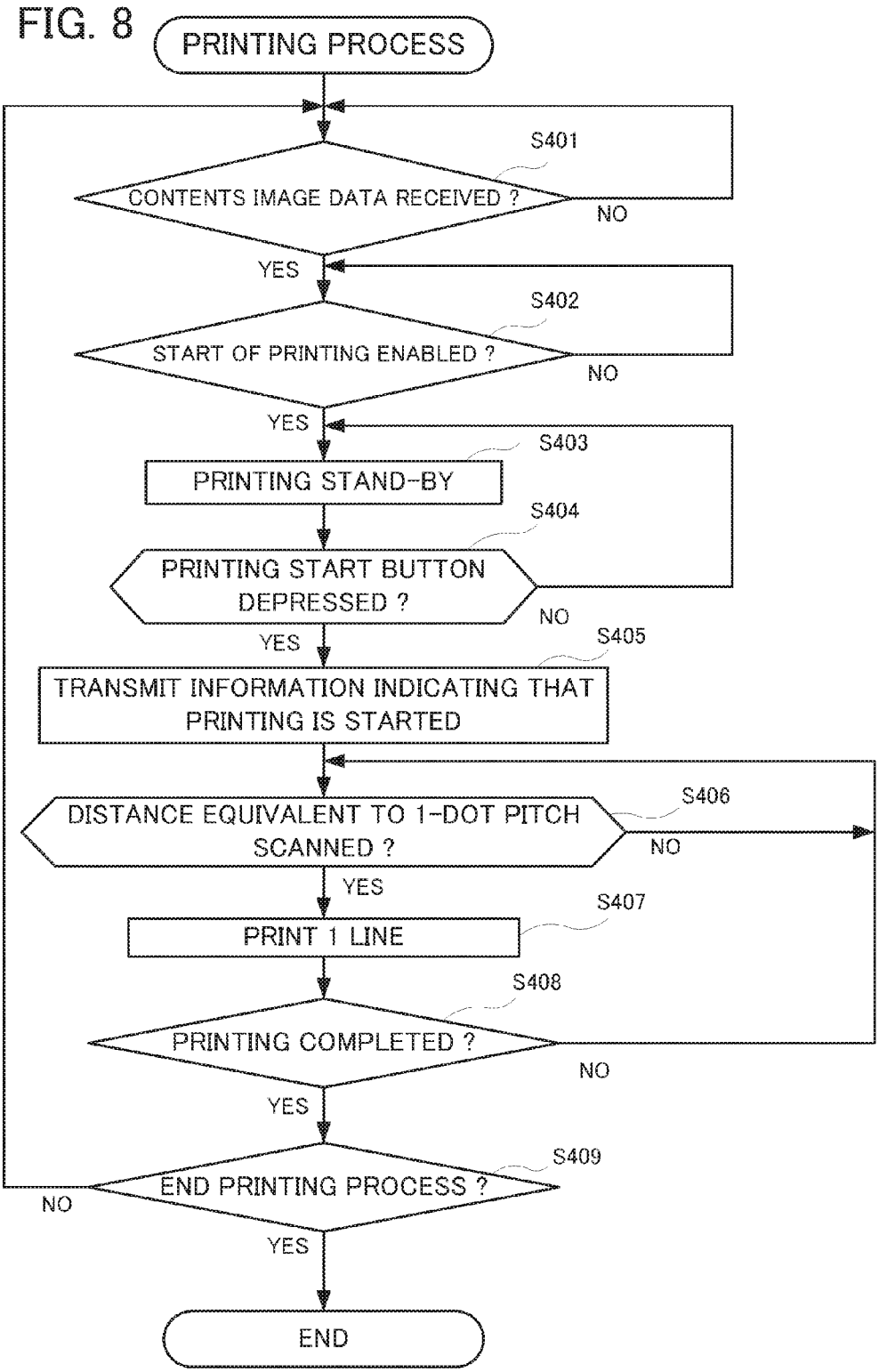
FIG. 8 is a flowchart illustrating a printing process executed by the handy printer according to the embodiment of the present disclosure.

In response to the user instruction to start the printing process, the handy printer 100 starts the printing process illustrated in FIG. 8.

First, the contents obtainer 111 stands by in the status capable of receiving the corresponding image data to the contents, and determines (step S401) whether or not the corresponding image data to the contents image is received.

When the corresponding image data to the contents image has not been received yet (step S401: NO), the process in the step S401 is repeated.

When the corresponding image data to the contents image is received (step S401: YES), the printing head controller 112 determines (step S402) whether or not the information indicating that the start of printing is enabled is received from the terminal device 200.

When the information indicating that the start of printing is enabled has not been received yet from the terminal device 200 (step S402: NO), the process in the step S402 is repeated.

When the information indicating that the start of printing is enabled is received from the terminal device 200 (step S402: YES), the printing head controller 112 stands by (step S403) in the status capable of starting the printing when the start button 150 is depressed.

Next, the printing head controller 112 determines (step S404) whether or not the start button 150 is depressed.

When determining (step S404: NO) that the start button 150 has not been depressed yet, the printing head controller 112 returns the process to the step S403, and repeats the processes in the step S403 and in the step S404.

When determining (step S404: YES) that the start button 150 is depressed, the printing head controller 112 transmits (step S405) information indicating the start of printing to the terminal device 200.

Next, the printing head controller 112 determines (step S406) whether or not the printing head 140 has scanned (has been moved) by a distance equivalent to a 1-dot pitch in the sub-scanning direction.

When the scanning by the distance equivalent to the 1-dot pitch has not been made yet (step S406: NO), the printing head controller 112 repeats the process in the step S406.

When the scanning by the distance equivalent to the 1-dot pitch is made (step S406: YES), the printing head controller 112 causes the printing head 140 to print (step S407) the 1-dot line that is a line of individual pixels arranged side by side in a line in the main-scanning direction of the contents.

Next, the printing head controller 112 determines (step S408) whether or not the contents has been printed up to the last part.

More specifically, the printing head controller 112 makes this determination based on whether or not there is still image data indicating the contents not printed yet.

When determining (step S408: NO) that the contents has not been printed up to the last part, the printing head controller 112 repeats the processes from the step S406 to the step S408 until the printing of the contents completes, and every time the scanning by the distance equivalent to the 1-dot pitch is made, the printing head controller 112 causes the printing head 140 to print the 1-dot line that is a line of individual pixels.

In a case where the printing head controller 112 determines (step S408: YES) that the contents has been printed up to the last part, the contents obtainer 111 determines (step S409) whether or not the user instruction to end the printing process is accepted.

When the instruction to end the printing process has not been accepted yet (step S409: NO), the process returns to the step S401. The contents obtainer 111 stands by in the status capable of receiving the image data on the contents, determines whether or not the image data on the contents is received, and repeats the processes from the step S401 to the step S409.

When the instruction to end the printing process is accepted (step S409: YES), the printing process ends.

Next, an explanation will be given of specific example processes executed by the printing system 1 according to this embodiment with reference to FIGS. 9, 10.

The user places, at the right end of the printing designated position to print the contents, the piece having the second reference marker 300 printed.

Next, the user 230 picks up the live-view image LI of the handy printer 100 from the upper space by the camera 230 of the terminal device 200.

Prior to the start of printing of the contents, the terminal device 200 displays, on the display device 240, the image that has the first assisting image I1 indicating the printing preview in a case where the user prints the contents using the handy printer 100 and the second assisting image I2 indicating the printing preview in a case where the contents is printed up to the left end position of the second reference marker 300 in a manner laid over on the image of the real space.

Subsequently, in a case where the first assisting image I1 and the second assisting image I2 do not overlap with each other, the terminal device 200 lays over the third assisting image I3 indicating the direction to move the handy printer 100 on the image of the real space prior to the start of printing so as to enable the printing at the position of the second assisting image I2, thereby displaying the laid-over image on the display device 240.

Next, the terminal device 200 determines, in a case where the handy printer 100 starts printing at the presently placed position, the printing is made at the printing designated position based on the second reference marker 300 and the contents, and displays the determination result on the display device 240. Hence, the user can easily know from which position the handy printer 100 needs to start printing.

Subsequently, in response to the user control, the handy printer 100 starts the printing process, while at the same time, the terminal device 200 starts the print assisting process.

In a case where the terminal device 200 starts the print assisting process, the contents obtainer 211 accepts (step S101, see FIG. 5) the corresponding image data to the contents to be printed and input by the user via the operator 250.

Next, the contents obtainer 211 transmits (step S103, see FIG. 5), in a case where accepting (step S102: YES, see FIG. 5) the instruction to transmit the image data on the contents, such image data on the contents to the handy printer 100 via the communicator 220.

Subsequently, the handy printer 100 receives the image data on the contents, and the contents obtainer 111 determines (step S401: YES, see FIG. 8) that the image data on the contents is received.

Next, the terminal device 200 executes the displaying process (step S104, see FIG. 5).

In a case where the terminal device 200 executes the displaying process, the image obtainer 212 causes the camera 230 to start picking up (step S201, see FIG. 6) the live-view image LI of the camera 230.

Subsequently, the image obtainer 212 obtains (step S202: FIG. 6) the live-view image of the real space captured by the camera 230.

In a case where the user picks up the images of the first reference marker 102 and of the second reference marker 300 by the camera 230, the first marker detector 213 determines (step S203: YES, see FIG. 6) that the live-view image contains the first reference marker 102, and the second marker detector 214 determines (step S204: YES, see FIG. 6) that the live-view image contains the pattern of the second reference marker 300.

Subsequently, the image creator-displayer 215 determines (step S206, see FIG. 6) whether or not the handy printer 100 starts printing.

Since the handy printer 100 has not started printing yet at this time point, the image creator-displayer 215 determines (step S206: NO, see FIG. 6) that the handy printer 100 has not started printing yet, and executes the creating process of the information on the assisting images (step S207, see FIG. 6).

In the creating process of the information on the assisting image, the image creator-displayer 215 detects (step S301, see FIG. 7) the information on the position of the first reference marker 102 and that of the second reference marker 300 both contained in the live-view image LI.

Next, the first assisting image I1 is displayed (step S302, see FIG. 7) based on the information on the first reference marker 102, and the second assisting image I2 is displayed (step S303, see FIG. 7) based on the information on the second reference marker 300.

Subsequently, the determiner 216 determines (step S304, see FIG. 7) whether or not the first assisting image I1 and the second assisting image I2 overlap with each other.

Next, in a case where the determiner 216 determines (step S304: NO, see FIG. 7) that the first and second assisting images I1, I2 do not overlap with each other, the image creator-displayer 215 displays (step S305, see FIG. 7), on the display device 240, the information IN1 indicating that the start of printing is not enabled, and displays (step S306, see FIG. 7) the third assisting image I3 that is the arrow indicating the direction to move the handy printer 100.

Figure 10:
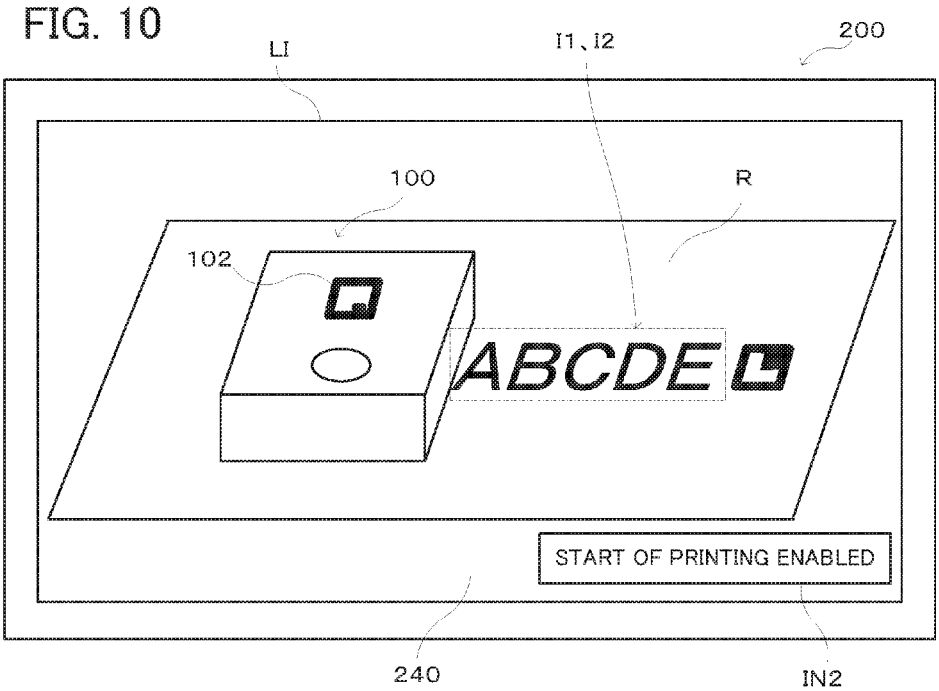
FIG. 10 is a diagram illustrating an example display scheme by the display device of the terminal device according to the embodiment of the present disclosure.

The user who is viewing the display device 240 moves the handy printer 100 at the position where the first assisting image I1 and the second assisting image I2 overlap with each other as illustrated in FIG. 10 in accordance with the third assisting image I3 that is an arrow indicating the direction to move the handy printer 100.

In a case where the handy printer 100 is placed at the position where the first assisting image I1 and the second assisting image I2 overlap with each other, the determiner 216 determines (step S304: YES, see FIG. 7) that the first assisting image I1 and the second assisting image I2 overlap with each other. Next, the image creator-displayer 215 displays (step S307, see FIG. 7), on the display device 240, the information IN2 indicating that the start of printing is enabled, and transmits (step S308, see FIG. 7) the information indicating that the start of printing is enabled to the handy printer 100.

In a case where the handy printer 100 receives (step S402: YES, see FIG. 8) the information indicating that the start of printing is enabled from the terminal device 200, the printing head controller 112 stands by (step S403, see FIG. 8) in the status capable of starting the printing in a case where the start button 150 is depressed.

Next, in a case where the user who is viewing the displayed information IN2 on the display device 240 indicating that the start of printing is enabled depresses (step S404: YES, see FIG. 8) the start button 150, the handy printer 100 transmits (step S405, see FIG. 8) the information indicating the start of printing to the terminal device 200.

In a case where receiving the information indicating that the printing has started, the terminal device 200 clears out (step S208, see FIG. 6) the first to third assisting images I1, I2, and I3, and ends (step S209, see FIG. 6) the picking-up action of the live-view image LI.

Subsequently, the process returns to the step S105 in the print assisting process. Next, in a case where the instruction to end the print assisting process is input (step S105: YES, see FIG. 5), the terminal device 200 ends the print assisting process.

Next, in a case where the handy printer 100 scans (step S406: YES, see FIG. 8) by the distance equivalent to the 1-dot pitch, the printing head controller 112 causes the printing head 140 to print (step S407, see FIG. 8) the 1-dot line that is a line of individual pixels arranged side by side in a line in the main-scanning direction of the contents.

Subsequently, in a case where a determination is made (step S408: NO, see FIG. 8) that the contents has not been printed up to the last part, the processes from the step S406 to the step S408 are repeated until the printing of the contents completes, and every time the handy printer 100 scans by the distance equivalent to the 1-dot pitch, the printing head controller 112 causes the printing head 140 to print the 1-dot line that is a line of individual pixels.

In a case where the printing head controller 112 determines (step S408: YES, see FIG. 8) that the contents has been printed up to the last part, the contents obtainer 111 accepts (step S409: YES, see FIG. 8) the instruction to end the printing process, and ends the printing process.

As explained above, according to the printing system 1 in this embodiment, in a case where the contents is to be printed on the print medium R by the handy printer 100, the terminal device 200 functions as an extended reality displaying device that displays the first to third assisting images I1 to I3 for guiding the user to move the handy printer 100 to the printing start position in such a way that the handy printer 100 is capable of printing the contents at the printing designated position based on the second reference marker 300 and the contents.

As explained above, by displaying the first to third assisting images I1 to I3 guiding to the printing start position, the user is enabled to easily scan even if the user does not get familiar with how to use this handy printer 100, and to print the contents at the desired position.

In addition, a determination is made as to whether or not the printing completes at the left end position of the second reference marker 300 in a case where the handy printer 100 starts the printing at the presently placed position, and this determination result is displayed on the display device 240.

Hence, the user can easily know from which position the handy printer 100 should start printing.

According to this printing system 1, by simply disposing the first reference marker 102 on the handy printer 100, and by also simply disposing the second reference marker 300 at the position where the contents is to be printed, the handy printer 100 can be downsized in comparison with a case in which the handy printer 100 itself includes the own display that displays the preview image of the contents.

MODIFIED EXAMPLES

According to the printing system 1 in the above embodiment, the display device 240 of the terminal device 200 displays information, such as "the start of printing not enabled", and "the start of printing is enabled", and requests the user as to whether or not to start the printing. However, the request as to whether or not to start the printing may be made by an indicator like an LED that serves as a notifier provided on the handy printer 100. More specifically, in a case where the start of printing is not enabled, the LED emits red light, and in a case where the start of printing is enabled, the LED emits green light.

The terminal device 200 may include a speaker as a notifier, and may notify the user of the information indicating that the start of printing is not enabled or the start of printing is enabled by sounds.

In this case, first, the terminal device 200 creates, based on the position of, within the live-view image LI, the first reference marker 102 disposed on the handy printer 100 and contained in the live-view image LI and detected by the first marker detector 213, and the position of within the live-view image LI, the second reference marker 300 disposed on the print medium R contained in the live-view image LI and detected by the second marker detector 214 of the terminal device 200, at least either information indicating whether or not the handy printer 100 is placed at the printing designated position based on the second reference marker 300 and the contents, or information indicating the direction and distance for the relative position to the handy printer 100 to the printing designated position.

Next, the terminal device 200 transmits the created information to the control unit 110 of the handy printer 100 via the communicator 220 of the terminal device 200 and the communicator 120 of the handy printer 100.

Subsequently, the handy printer 100 may notify the user of information indicating that the handy printer 100 is not placed at the printing designated position based on the second reference marker 300 and the contents on the basis of the received information, or may notify the user of, in a case where receiving the information indicating that the handy printer 100 is placed at the printing designated position, the information indicating that the start of printing is not enabled or the start of printing is enabled by the notifier like the LED or the speaker.

The user may be guided so as to move the handy printer 100 to the printing start position by the notifier like the LED or the speaker based on the information on the direction and the distance indicating the relative position of the printing designated position to the handy printer 100.

The handy printer 100 may further include a notifier that is in the form of a display, the captured image of the real space containing the handy printer 100 may be displayed on such a display, and the first to third assisting images I1 to I3 may be displayed within this captured image.

In this case, the information obtained by the image obtainer 212 of the terminal device 200 is transmitted to the control unit 110 of the handy printer 100 via the communicator 220 of the terminal device 200 and the communicator 120 of the handy printer 100, and the handy printer 100 is capable of guiding the user so as to move the handy printer 100 to the printing start position by displaying the received information on the display of the handy printer 100.

The control unit 110 of the handy printer 100 may create at least one of the pieces of above information based on the above received information.

In this case, the control unit 110 of the handy printer 100 may function as the first marker detector 213 and the second marker detector 214.

According to the printing system 1 in the above embodiment, the explanation has been given of an example case in which the second reference marker 300 is disposed on the print medium R. However, the second reference marker 300 may be a pattern printed on the print medium R beforehand.

According to the printing system 1 in the above embodiment, the terminal device 200 guides the printing start position of the handy printer 100 so as to print the contents at the right side of the second reference marker 300. However, the terminal device 200 may detect the second reference marker that is a ruled line or a grid (a pattern printed on the print medium R beforehand) printed on the print medium R, and may display, on the display device 240, the assisting images I1, I2, and I3 guiding the printing start position of the handy printer 100 so as to print the contents between the ruled lines of the print medium R or within the grid thereof.

Figure 11:
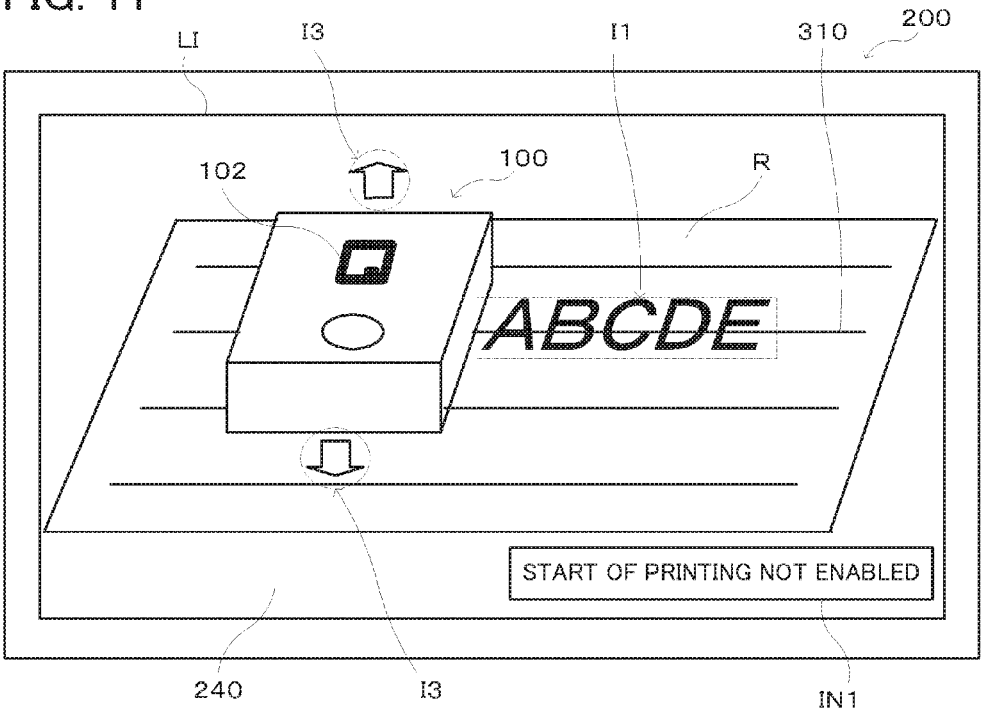
FIG. 11 is a diagram illustrating an example display scheme by the display device of the terminal device according to the embodiment of the present disclosure.

More specifically, the second marker detector 214 detects the second reference marker 310 that is a ruled line printed on the print medium R beforehand as illustrated in FIG. 11.

The image creator-displayer 215 displays, on the display device 240, the printing preview (first assisting image I1) in a case where the handy printer 100 starts printing at the presently placed position.

In a case where the determiner 216 determines that the first assisting image I1 and the second reference marker 310 (ruled line) overlap with each other, the image creator-displayer 215 displays, on the display device 240, the third assisting image I3 (an upward arrow or a downward arrow) so as to guide the user to move the handy printer 100 upwardly or downwardly.

The image creator-displayer 215 determines that the start of printing is not enabled, and displays, at the lower right part of the display device 240, the information indicating that the start of printing is not enabled yet.

Figure 12:
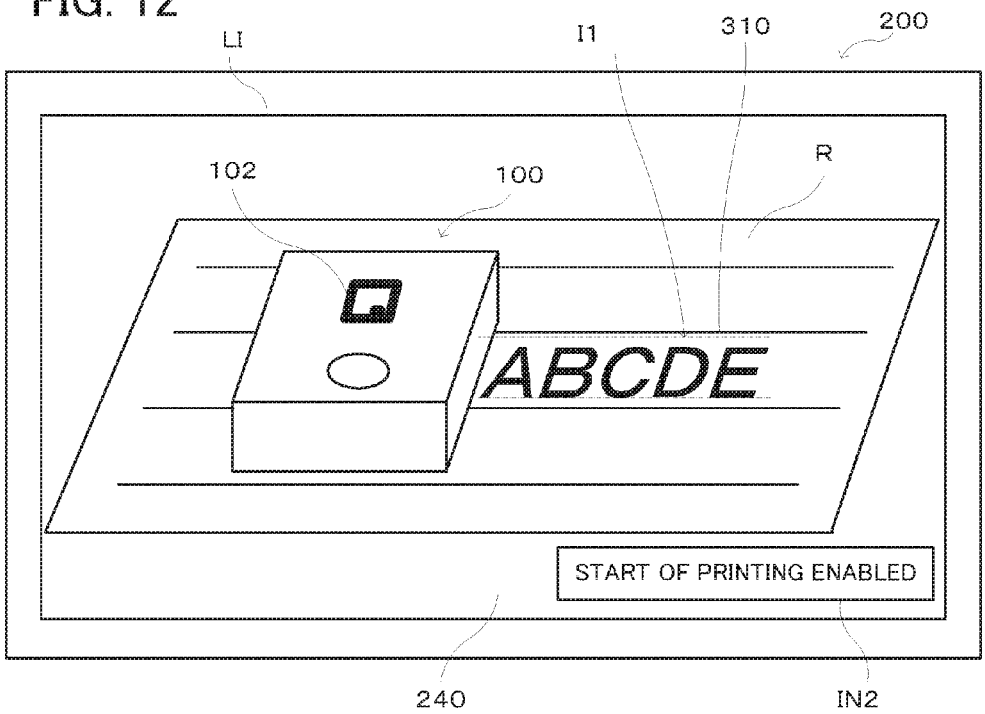
FIG. 12 is a diagram illustrating an example display scheme by the display device of the terminal device according to the embodiment of the present disclosure.

The user who is viewing the displayed information on the display device 240 moves the handy printer 100 downwardly or upwardly in such a way that the first assisting image I1 is placed between the ruled lines as illustrated in FIG. 12.

In a case where the first assisting image I1 is placed between the ruled lines, the determiner 216 determines that the printing is enabled, and displays, at the lower right part of the display device 240, information indicating that the start of printing is enabled. In a case where the user depresses the start button 150, and scans by the handy printer 100, the contents is printed on the print medium R.

The terminal device 200 may detect an edge part RE of the print medium R as the second reference marker 320, and may display, on the display device 240, the second assisting image I2 that guides the handy printer 100 so as to print the contents surely within the print medium R.

Figure 13:
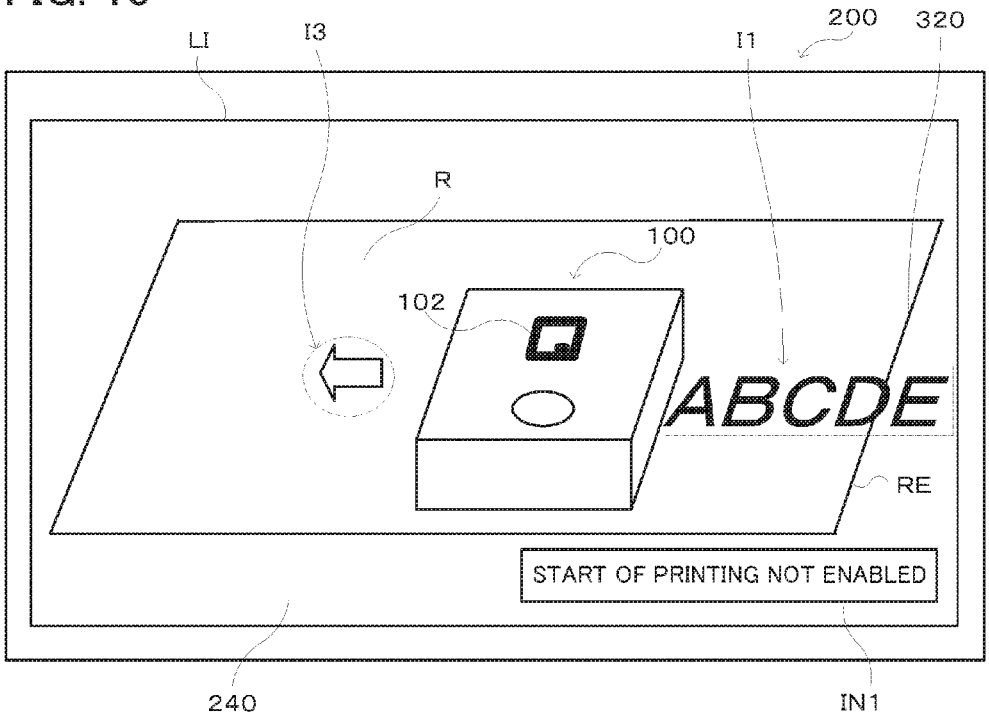
FIG. 13 is a diagram illustrating an example display scheme by the display device of the terminal device according to the embodiment of the present disclosure.

More specifically, the second marker detector 214 detects the second reference marker 320 that is the edge part RE of the print medium R illustrated in FIG. 13.

The image creator-displayer 215 displays, on the display device 240, the printing preview (first assisting image I1) in a case where the handy printer 100 starts printing at the presently placed position.

In a case where the determiner 216 determines that the first assisting image I1 is out of the print medium R from the right side, the image creator-displayer 215 displays, on the display device 240, the third assisting image I3 (that is, a leftward arrow) that guides the handy printer 100 toward the left side.

At this time, the determiner 216 determines that the start of printing is not enabled, and displays, for example, at the lower right part of the display device 240, the information indicating that the start of printing is not enabled.

Figure 14:
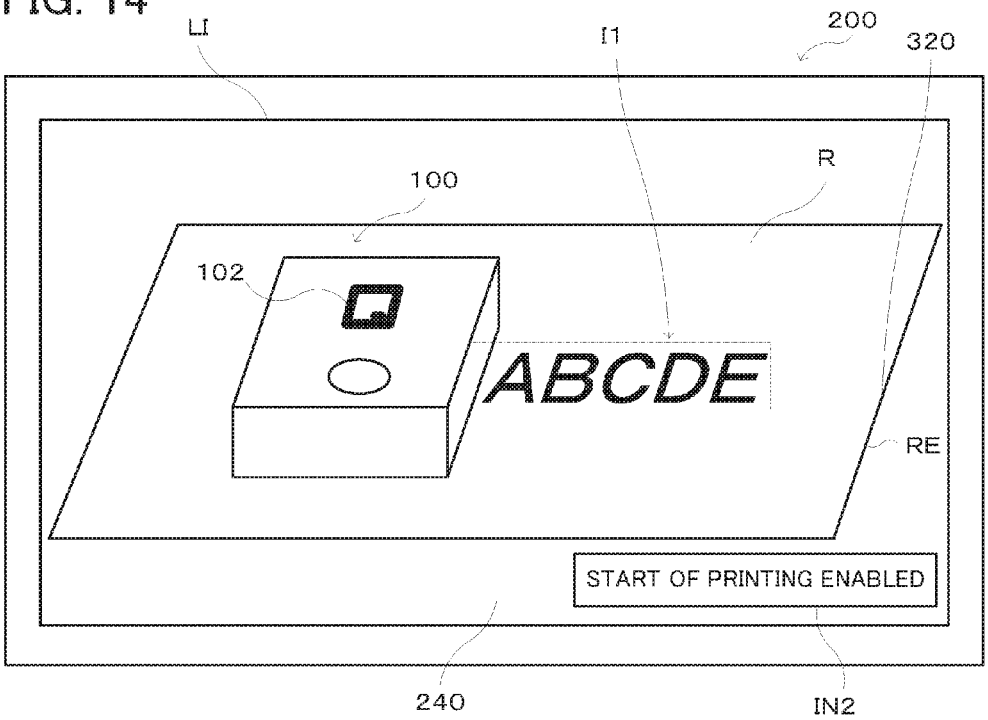
FIG. 14 is a diagram illustrating an example display scheme by the display device of the terminal device according to the embodiment of the present disclosure.

The user who is viewing this information on the display device 240 moves the handy printer 100 to the left side in such a way that the first assisting image I1 is surely within the print medium as illustrated in FIG. 14.

In a case where the first assisting image I1 is disposed so as to be surely within the print medium R, the determiner 216 determines that the start of printing is enabled, and displays, at the lower right part of the display device 240, the information indicating that the start of printing is enabled. Next, in a case where the user depresses the start button 150, and the handy printer 100 scans, the contents is printed on the print medium R.

In the above embodiment, the first marker detector 213 detects the first reference marker 102 disposed on the handy printer 100 and contained in the live-view image LI, and specifies the position of the handy printer 100 within such an image and the sub-scanning direction based on this first reference marker 102. However, the present disclosure is not limited to the above embodiment, and all of or a part of the handy printer 100 contained in the live-view image LI, for example, the casing 101 of the handy printer 100 may be subjected to an image recognition in order to specify the position of the handy printer 100 and the sub-scanning direction.

In this case, the casing 101 of the handy printer 100 serves as the first reference marker. In this case, although the casing 101 serves as the first reference marker, a part thereof may serve as the first reference marker, or the part other than the casing 101 of the handy printer 100 may serve as the first reference marker.

In the above embodiment, the terminal device 200 displays the first to third assisting images I1 to I3 in a manner laid over on the live-view image LI. However, the terminal device 200 may display, in a manner laid over on the live-view image LI of the real space containing the handy printer 100, the second assisting image I2 at the printing designated position that designates the position which is based on at least the second reference marker 300 and the contents, and on which the printing is to be made.

In this case, in a case where the displacement of the position of the handy printer 100 relative to the printing start position is large to some extent, the user is capable of recognizing that the presently placed position of the handy printer 100 is displaced from the printing designated position based on the position of the handy printer 100 displayed in the live-view image LI and the position of the second assisting image I2. Accordingly, such a second assisting image I2 is also recognizable as an image that guides the user.

Hence, in this case, the image creator-displayer 215 creates the information on the second assisting image I2 that is a printing preview image of the printing designated position based on the contents and the position of the second reference marker 300, and displays, on the display device 240, the created second and third assisting images I2, I3 in a manner laid over on the live-view image LI.

In addition, in this case, the second assisting image I2 may be displayed in a blinking manner, or the brightness of the second assisting image I2 and the contrast thereof may be increased than those of the other part in the live-view image LI so as to enhance the user guiding effect to move the handy printer 100 to the printing start position.

Still further, in this case, the closer the position of the handy printer 100 to the printing start position becomes by the user manual scanning, the faster or slower the second assisting image I2 may be blinked or the higher or lower the contrast may be changed, or the color may be changed.

In this case, in a case where the distance between the position of the handy printer 100 and the printing start position becomes shorter than a predetermined distance by the user manual scanning, at least either the first assisting image I1 or the third assisting image I3 may be displayed in a manner laid over on the live-view image LI.

According to this modified example, first, the second assisting image I2 is displayed in a manner laid over on the live-view image LI, is combined with the other assisting images in accordance with the distance between the position of the handy printer 100 and the printing start position, and further displayed in the manner laid over on the live-view image LI. However, the assisting image to be displayed initially may be any one of the first to third assisting image I1 to I3 as appropriate, and the other assisting images to be displayed later in accordance with the distance between the position of the handy printer 100 and the printing start position may be the other assisting images among the first to third assisting images I1 to I3 other than the assisting image initially displayed.

In a case where any one of the first to third assisting images I1 to I3 is initially displayed as appropriate in a manner laid over on the live-view image LI, the factors relating to the visual effect of at least one of those assisting images, such as blinking, brightness, contrast, or color, may be displayed differently from that of the other part in the live-view image LI, and each visual effect may be changed in accordance with the distance between the position of the handy printer 100 and the printing start position.

According to the above embodiment, the terminal device 200 displays the first assisting image I1 and the second assisting image I2 in a manner laid over on the live-view image LI. However, the terminal device 200 may display, in a manner laid over on the live-view image LI, the minimum frame surrounding the first assisting image I1, a straight line that has an equal length to the lateral width of the first assisting image I1 instead of displaying the first assisting image I1, and may display the minimum frame surrounding the second assisting image I2, a straight line that has an equal length to the lateral width of the second assisting image I2 instead of displaying the second assisting image I2.

Still further, the terminal device 200 may display, in a manner laid over on the live-view image LI, a straight line that has a predetermined length or a rectangular that has a predetermined lateral width instead of displaying the first assisting image I1, or may display a straight line that has the same predetermined length as the foregoing length or a rectangular that has the same predetermined lateral width as the foregoing lateral width instead of displaying the second assisting image I2. In this case, the predetermined length and lateral width may be always a constant value regardless of the length of the contents to be printed.

Although the first reference marker 102 has been displayed in the live-view image LI, in a case where the first reference marker 102 is eliminated within the displayed live-view image LI by the user's hand that manually scans the handy printer 100 during the printing, the image creator-displayer 215 of the terminal device 200 may keep displaying, as the first reference marker 102, a part of the external shape of the handy printer 100 displayed in the live-view image LI in such a way that each assisting images are displayed in a manner laid over on the live-view image LI.

In the above embodiment, the terminal device 200 displays the first to third assisting images I1 to I3 in a manner laid over on the live-view image LI. However, the terminal device 200 may display the first to third assisting images I1 to I3 in a manner laid over on a still image.

In the above embodiment, the first to third assisting images I1 to I3 are displayed on the display device 240 in a manner laid over on the live-view image LI that represents the real space. However, the first to third assisting images I1 to I3 may be displayed on a head-mount type display like an eyeglass display.

In this case, the head-mount type display displays the first to third assisting images I1 to I3 in a manner laid over on, for example, a transparent real space.

The user who is wearing such a head-mount type display views the first to third assisting images I1 to I3 displayed in a manner laid over on the transparent real space, enabling this user to easily scans the handy printer 100.

The main part of the terminal device 200 including the CPU, the RAM, and the ROM, and executing the print assisting process can be accomplished by not only a special-purpose system but also a normal information mobile terminal (for example, a smartphone or a tablet PC) and a personal computer.

For example, a computer program to execute the above processes may be distributed in a manner stored in a non-transitory computer-readable recording medium (flexible disk, a Compact Disc (CD)-ROM, or a Digital Versatile Disc (DVD)-ROM), and may be installed in an information mobile terminal to accomplish an information terminal that executes the above processes.

This computer program may be stored beforehand in a storage device of a server device over a communication network like the Internet, and may be, for example, downloaded to a normal information processing terminal and the like, to accomplish the information processing device.

In a case where the function of the terminal device 200 is accomplished by a share work between an Operating System (OS) and an application program, or a cooperative work by the OS and the application program, only the application program part may be stored in a non-transitory recording medium or a storage device.

The computer program may be superimposed on carrier waves, and may be distributed via a communication network. For example, this computer program may be posted on a Bulletin Board System (BBS) over the communication network, and may be distributed via the network.

In addition, by starting-up this computer program, and executing such a program like the other application programs under the control by the OS, a configuration to execute the above processes may be accomplished.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A print assisting device comprising:

an imaging device;

a notifier including a display device; and a processor, wherein the processor:

obtains information on a captured image captured by the imaging device, the captured image including a first reference marker of a printing device being a manual scanning type and a second reference marker of a print medium on which the printing device is placed;

detects information on the first reference marker and information on the second reference marker from the information on the captured image;

creates, as an assisting image, at least any one of (1) a first image which is an image of contents that is printed by the printing device on the print medium in a case where the printing device is scanned from a current position of the printing device obtained from the information on the first reference marker, (2) a second image which is an image of the contents that is printed by the printing device on the print medium in a case where the printing device is scanned from a printing start position where the printing device prints the contents at a printing designated position obtained from the information on the second reference marker and information on the contents, and (3) a third image to guide a position of the printing device to the printing start position; and causes the display device to display the assisting image superimposed on the captured image.

2. The print assisting device according to claim 1, wherein the processor:

creates the first image and the second image as the assisting image; and determines, based on the first image and the second image, whether or not the printing device is placed at a printing start position where the contents is printed at the printing designated position.

3. The print assisting device according to claim 2, wherein the processor:

determines that the printing device is placed at the printing start position in a case where a ratio of overlap between a region of the first image and a region of the second image is equal to or greater than a predetermined value; and determines that the printing device is not placed at the printing start position in a case where the ratio of overlap is less than the predetermined value.

4. The print assisting device according to claim 2, wherein the processor creates the third image in a case where the processor determines that the printing device is not placed at the printing start position.

5. The print assisting device according to claim 2, wherein the processor causes the notifier to give a notification indicating that a start of a printing by the printing device is enabled in a case where the processor determines that the printing device is placed at the printing start position.

6. The print assisting device according to claim 2, further comprising a communicator for communicating information with the printing device, wherein the processor transmits information indicating that a start of a printing is enabled via the communicator in a case where the processor determines that the printing device is placed at the printing start position.

7. The print assisting device according to claim 1, wherein:

the notifier is wearable for a user; and the display of the notifier is disposed at a position within a visible range for the user with the notifier being worn by the user.

8. The print assisting device according to claim 1, wherein the second reference marker is any one of an image pattern printed on a piece disposed on the print medium, an image pattern printed on the print medium, and an edge of the print medium.

9. A printing device comprising:

a printing head that prints a contents on a print medium while moving on the print medium;

a casing provided with, on an outer surface, a first reference marker indicating a placed position of the printing device and a to-be-moved direction of the printing device;

a communicator that receives, from a print assisting device different from the printing device, information on a captured image of a second reference marker of the print medium and the first reference marker;

a notifier; and a processor, wherein the processor:

detects information on the first reference marker and information on the second reference marker from the information on the captured image;

determines, based on a print position and a printing designated position, the print position being a position of a contents that is printed by the printing head on the print medium in a case where the printing device is scanned from a current position of the printing device obtained from the information on the first reference marker, and the printing designated position being a position obtained from the information on the second reference marker and the information on the contents, whether or not the printing device is placed at a printing start position where the printing head prints the contents at the printing designated position; and causes the notifier to give a notification indicating that a start of a printing by the printing head is enabled and sets the printing device to be in a status capable of printing by the printing head in a case where the processor determines that the printing device is placed at the printing start position.

10. The printing device according to claim 9, wherein the processor:

creates a first image in a case where the printing head prints the contents from the current position of the printing position, and a second image in a case where the contents is printed at the printing designated position;

determines that the printing device is placed at the printing start position in a case where a ratio of overlap between a region of the first image and a region of the second image is equal to or greater than a predetermined value; and determines that the printing device is not placed at the printing start position in a case where the ratio of overlap is less than the predetermined value.

11. The printing device according to claim 9, wherein the processor causes the notifier to send a notification indicating information for guiding the printing device to the printing start position in a case where the processor determines that the printing device is not placed at the printing start position.

12. The printing device according to claim 9, wherein:

the notifier comprises a display device; and the processor creates, as an assisting image, at least any one of (1) a first image which is an image of contents that is printed by the printing head on the print medium in a case where the printing device is scanned from the current position of the printing device, (2) a second image which is an image of the contents that is printed by the printing device on the print medium in a case where the printing device is scanned from the printing start position, and (3) a third image to guide a position of the printing device to the printing start position, and causes the display device to display the assisting image superimposed on the captured image.

13. A printing device comprising:

a printing head that prints a contents on a print medium while moving on the print medium;

a casing provided with, on an outer surface, a first reference marker indicating a placed position of the printing device and a to-be-moved direction;

a communicator that receives, from a print assisting device different from the printing device, information indicating whether or not the printing device is placed at a printing start position where the contents is printed at a preset printing designated position by the printing device, the information being determined based on a captured image of the print medium and the printing device placed on the print medium;

a notifier; and a processor, wherein the processor causes the notifier to give a notification indicating that a start of a printing is enabled by the printing head and causes the printing device to be in a status capable of printing by the printing head in a case where the printing device receives information indicating that the printing device is placed at the printing start position via the communicator from the print assisting device.

14. A printing system comprising:

a printing device being a manual scanning type; and a print assisting device, wherein:

the printing device comprises a printing head that prints a contents on a print medium while moving on the print medium, a casing provided with, on an outer surface, a first reference marker indicating a placed position of the printing device and a to-be-moved direction of the printing device, a first communicator that communicates information with the print assisting device, and a first processor;

the print assisting device comprises an imaging device, a notifier, a second communicator that communicates the information with the printing device, and a second processor;

the second processor of the print assisting device:

obtains information on a captured image captured by the imaging device, the captured image including a first reference marker of the printing device and a second reference marker of the print medium on which the printing device is placed;

detects information on the first reference marker and information on the second reference marker from the information on the captured image;

creates (1) a first image which is an image of contents that is printed by the printing device on the print medium in a case where the printing device is scanned from a current position of the printing device obtained from the information on the first reference marker, and (2) a second image which is an image of the contents that is printed by the printing device on the print medium in a case where the printing device is scanned from a printing start position where the printing device prints the contents at a printing designated position obtained from the information on the second reference marker and information on the contents;

determines, based on the first image and the second image, whether or not the printing device is placed at the printing start position where the contents is printed at the printing designated position, causes the notifier to give a notification indicating that a start of a printing by the printing device is enabled, and transmits, to the printing device via the second communicator, information indicating that the start of the printing is enabled; and the first processor of the printing device sets the printing device to be in a status capable of printing by the printing head in a case where the printing device receives the information from the print assisting device via the first communicator that the start of the printing is enabled.

15. The printing system according to claim 14, wherein:

the notifier of the print assisting device comprises a display device; and the second processor of the print assisting device creates a third image for guiding a position of the printing device from the current position of the printing device to the printing start position, and causes the display device to display at least one of the first image, the second image, and the third image superimposed on the captured image.

16. A printing system comprising:

a printing device being a manual scanning type; and a print assisting device, wherein:

the printing device comprises a printing head that prints a contents on a print medium while moving on the print medium, a casing provided with, on an outer surface, a first reference marker indicating a placed position of the printing device and a to-be-moved direction of the printing device, a first communicator that communicates information with the print assisting device, a notifier, and a first processor;

the print assisting device comprises an imaging device and a second communicator that communicates the information with the printing device;

the print assisting device transmits, via the second communicator, information on a captured image obtained by imaging the first reference marker of the printing device and a second reference marker of the print medium where the printing device is placed by the imaging device;

the printing device receives, via the first communicator, the information on the captured images transmitted from the print assisting device;

the processor of the printing device:

detects information on the first reference marker and information on the second reference marker from the information on the captured images;

determines, based on a print position and a printing designated position, the print position being a position of an image of a contents that is printed by the printing head on the print medium in a case where the printing head is scanned from a current position of the printing device obtained from the information on the first reference marker, and the printing designated position being a position obtained from the information on the second reference marker and the information on the contents, whether or not the printing device is placed at a printing start position where the printing head prints the contents at the printing designated position; and causes the notifier to give a notification indicating that a start of a printing by the printing device is enabled and sets the printing device to be in a status capable of printing by the printing head in a case where the processor determines that the printing device is placed at the printing start position.

17. The printing system according to claim 16, wherein:

the notifier of the printing device comprises a display device; and the processor creates, as information on an assisting image, at least any one of (1) a first image which is an image of contents that is printed by the printing head on the print medium in a case where the printing device is scanned from the current position of the printing device, (2) a second image which is an image of the contents that is printed by the printing device on the print medium in a case where the printing device is scanned from the printing start position, and (3) a third image to guide a position of the printing device to the printing start position, and causes the display device to display the assisting image superimposed on the captured image.

18. A determining method comprising:

obtaining information on a captured image captured by an imaging device, the captured image including a first reference marker of a printing device being a manual scanning type and a second reference marker of a print medium on which the printing device is placed;

detecting information on the first reference marker and information on the second reference marker from the information on the captured image; and determining, based on a print position and a printing designated position, the print position being a position of a contents that is printed by the printing device on the print medium in a case where the printing device is scanned from a current position of the printing device obtained from the information on the first reference marker, and the printing designated position being a position obtained from the information on the second reference marker and the information on the contents, whether or not the printing device is placed at a printing start position where the printing device prints the contents at the printing designated position.

19. A non-transitory computer readable recording medium having stored therein a notification control program, the notification control program causing a computer to:

obtain information on a captured image captured by an imaging device, the captured image including a first reference marker of a printing device being a manual scanning type and a second reference marker of a print medium on which the printing device is placed;

detect information on the first reference marker and information on the second reference marker from the information on the captured image; and determine, based on a print position and a printing designated position, the print position being a position of a contents that is printed by the printing device on the print medium in a case where the printing device is scanned from a current position of the printing device obtained from the information on the first reference marker, and the printing designated position being a position obtained from the information on the second reference marker and the information of the contents, whether or not the printing device is placed at a printing start position where the printing device prints the contents at the printing designated position.

* * * * *